US009824614B2

(12) United States Patent
Lee et al.

(10) Patent No.: US 9,824,614 B2
(45) Date of Patent: Nov. 21, 2017

(54) GATE DRIVING METHOD AND DISPLAY DEVICE

(71) Applicant: LG DISPLAY CO., LTD., Seoul (KR)

(72) Inventors: Dong-Woo Lee, Buyeo-eup (KR); SungGae Lee, Gunpo-si (KR)

(73) Assignee: LG DISPLAY CO., LTD., Seoul (KR)

( * ) Notice: Subject to any disclaimer, the term of this patent is extended or adjusted under 35 U.S.C. 154(b) by 168 days.

(21) Appl. No.: 14/560,513

(22) Filed: Dec. 4, 2014

(65) Prior Publication Data

US 2015/0154902 A1 Jun. 4, 2015

(30) Foreign Application Priority Data

Dec. 4, 2013 (KR) ..... 10-2013-0150075
Nov. 10, 2014 (KR) ..... 10-2014-0155449

(51) Int. Cl.
*G09G 3/36* (2006.01)
*G09G 3/20* (2006.01)

(52) U.S. Cl.
CPC ..... *G09G 3/20* (2013.01); *G09G 2310/0267* (2013.01); *G09G 2310/04* (2013.01); *G09G 2310/08* (2013.01); *G09G 2330/021* (2013.01)

(58) Field of Classification Search
CPC ..... G09G 2310/0267; G09G 2310/021; G09G 3/3674; G09G 2310/0218; G09G 2310/0205
See application file for complete search history.

(56) References Cited

U.S. PATENT DOCUMENTS

2009/0174640 A1 7/2009 Nose et al.
2010/0097367 A1* 4/2010 Kitayama ..... G09G 3/36 345/213
2014/0049512 A1* 2/2014 Yang ..... G06F 3/0416 345/174

FOREIGN PATENT DOCUMENTS

CN 1553418 A 12/2004
CN 102103823 A 6/2011
CN 102456321 A 5/2012
JP 2006-023452 A 1/2006

OTHER PUBLICATIONS

Office Action for Chinese Patent Application No. 201410735163.4, dated Sep. 26, 2016, pp. 1-7.

* cited by examiner

*Primary Examiner* — Dennis Joseph
(74) *Attorney, Agent, or Firm* — Seed Intellectual Property Law Group LLP

(57) ABSTRACT

Disclosure are a display device that provides effective partitive driving using an optimal signal line structure, and provides partial driving that effectively drive a partial area under the signal line structure and partial driving, and a gate driving method thereof.

11 Claims, 35 Drawing Sheets

GATE DRIVING METHOD AND DISPLAY DEVICE

CROSS-REFERENCE TO RELATED APPLICATION

This application claims priority under 35 U.S.C. §119(a) to Korean Application Serial Nos. 10-2013-0150075 & 10-2014-0155449, which were filed in the Korean Intellectual Property Office on Dec. 4, 2013 & Nov. 10, 2014, the entire content of which is hereby incorporated by reference.

BACKGROUND

1. Field of the Disclosure

The present embodiments relate to a gate driving method and a displaying device.

2. Description of the Prior Art

With the development of information society, various types of requirements for a display device for displaying an image are increasing, and recently, various display devices, such as a Liquid Crystal Display (LCD) device, a Plasma Display Device (PDD), and an Organic Light Emitting Display (OLED) Device, are being used.

The display device includes a display panel, which includes data lines and gate lines. Pixels are defined by the the data lines and the gate lines formed on the display panel. The display device further includes a data driving unit providing a data signal to the data lines, a gate driving unit providing a scan signal to the gate lines, a timing controller controlling driving times of the data driving unit and the gate driving unit, etc.

To effectively drive a display panel, a partitive driving method has been proposed that divides a display area (also referred to as an Active Area (AA)) into several parts and drives the same.

According to a conventional partitive driving method requires separate control signals for controlling the partitive driving. Accordingly, separate signal lines for providing the separate control signals to a driving unit need to be added. This may cause difficulty in a display panel process, and may incur a drawback that increases a bezel of a display panel.

In the conventional display device, although an image is changed in only a partial area of an active area (i.e. a display area) in comparison to a previous frame, the gate driving unit does not consider the image change generated only in the partial area, and sequentially drives all of the gate lines of the display panel. Thus, a driving time may be unnecessarily longer, and power consumption may be generated unnecessarily.

SUMMARY

A display device includes: a display panel in which a plurality of data lines and a plurality of gate lines; a data driving unit that drives the plurality of data lines; a gate driving unit that drives the plurality of gate lines, and includes a plurality of gate driving integrated circuits; and a timing controller that controls the data driving unit and the gate driving unit.

In this display device, the plurality of gate driving integrated circuits are separated based on M (a natural number greater than or equal to 2) entities so as to be classified into N (a natural number greater than or equal to 2) gate driving groups, and the N gate driving groups correspond to N partial areas of the display panel, and separately operate based on a group driving start signal and a group driving refresh signal.

In accordance with another aspect of the present invention, there is provided a display device, the display device including: a gate driving unit that includes a plurality of gate driving integrated circuits; and a timing controller that executes a control to sequentially output a scan signal from two or more gate driving integrated circuits included in a gate driving group, selected for driving one frame, among two or more gate driving groups partitively including the plurality of gate driving integrated circuits.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Figure 1:
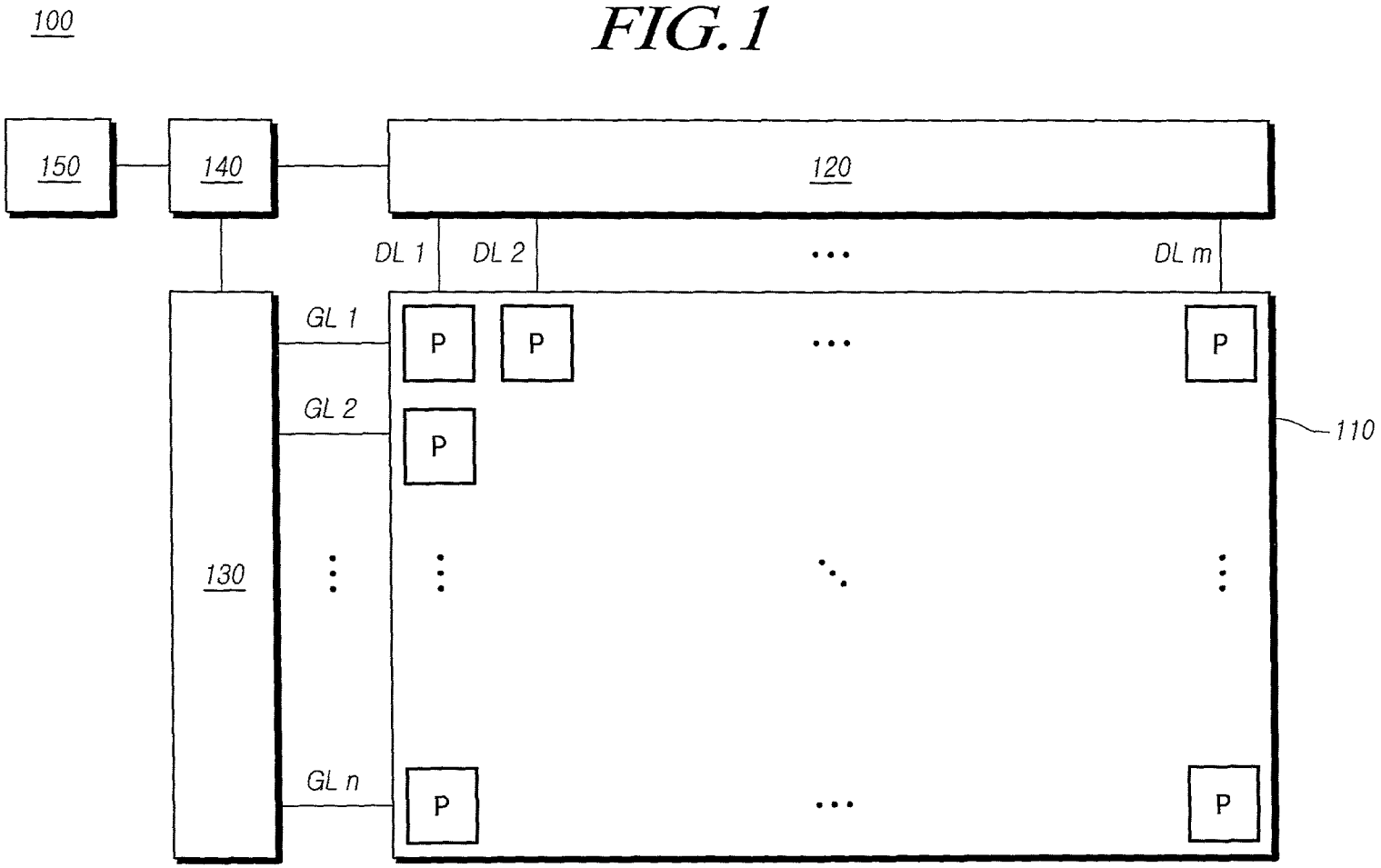
FIG. 1 is a schematic view illustrating a display device according to the present embodiments.

Hereinafter, exemplary embodiments of the present invention will be described with reference to the accompanying drawings. In the following description, the same elements will be designated by the same reference numerals although they are shown in different drawings. Further, in the following description of embodiments of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected," "coupled" or "joined" to another component, a third component may be "connected," "coupled," and "joined" between the first and second components, although the first component may be directly connected, coupled or joined to the second component. Likewise, when it is described that a certain element is formed "on" or "under" another element, it should be understood that the certain element may be formed either directly or indirectly via a still another element on or under another element.

FIG. 1 is a schematic view illustrating a display device 100 according to an exemplary embodiment.

Referring to FIG. 1, the display device 100 according to an exemplary embodiment includes a display panel 110, a data driving unit 120, a gate driving unit 130, a timing controller 140, etc.

In the display panel 110, m number of data lines DL1 to DLm and n number of gate lines GL1 to GLn are formed. A plurality of pixels P are defined by a crossing of the formed m number of data lines DL1 to DLm and n number of gate lines GL1 to GLn.

The data driving unit 120 provides a data voltage to the m number of data lines DL1 to DLm.

The data driving unit 120 may include a plurality of data driving integrated circuits (i.e. a data driver ICs, may be referred to as a source driving integrated circuit). The plurality of data driving integrated circuits (ICs) may be connected to a bonding pad of the display panel 110 in a Tape Automated Bonding (TAB) manner or a Chip On Glass (COG) manner. Alternatively, the plurality of data driving ICs may be directly formed on the display panel 110 in a Gate In Panel (GIP) type, and may be integrated on the display panel 110 according to circumstances.

The gate driving unit 130 is for sequentially providing a scan signal to the n number of gate lines GL1 to GLn, and may include a plurality of gate driving ICs (i.e. a gate driver ICs).

The gate driving unit 130 may be positioned on only one side of the display panel 110 as illustrated in FIG. 1, or may be divided into two and positioned on both sides of the display panel 110, depending on a driving type.

In addition, the gate driving unit 130 may output one scan signal to one gate line in a single feeding manner, or may output two scan signals to one gate line in a double feeding manner, depending on the driving manner.

In addition, the plurality of gate driving ICs (i.e. the gate driver ICs) included in the gate driving unit 130 may be connected to the bonding pad of the display panel 110 in the TAB manner or the COG manner. Alternatively, the plurality of gate driving ICs may be directly formed on the display panel 110 in the GIP type, or may be integrated on the display panel 110 according to circumstances.

But, hereinafter, for convenience of description, it is assumed that the plurality of gate driving ICs (i.e. the gate driver IC) are the GIP type, and may be referred to as the GIP (i.e. a gate driver IC in panel).

Figure 2:
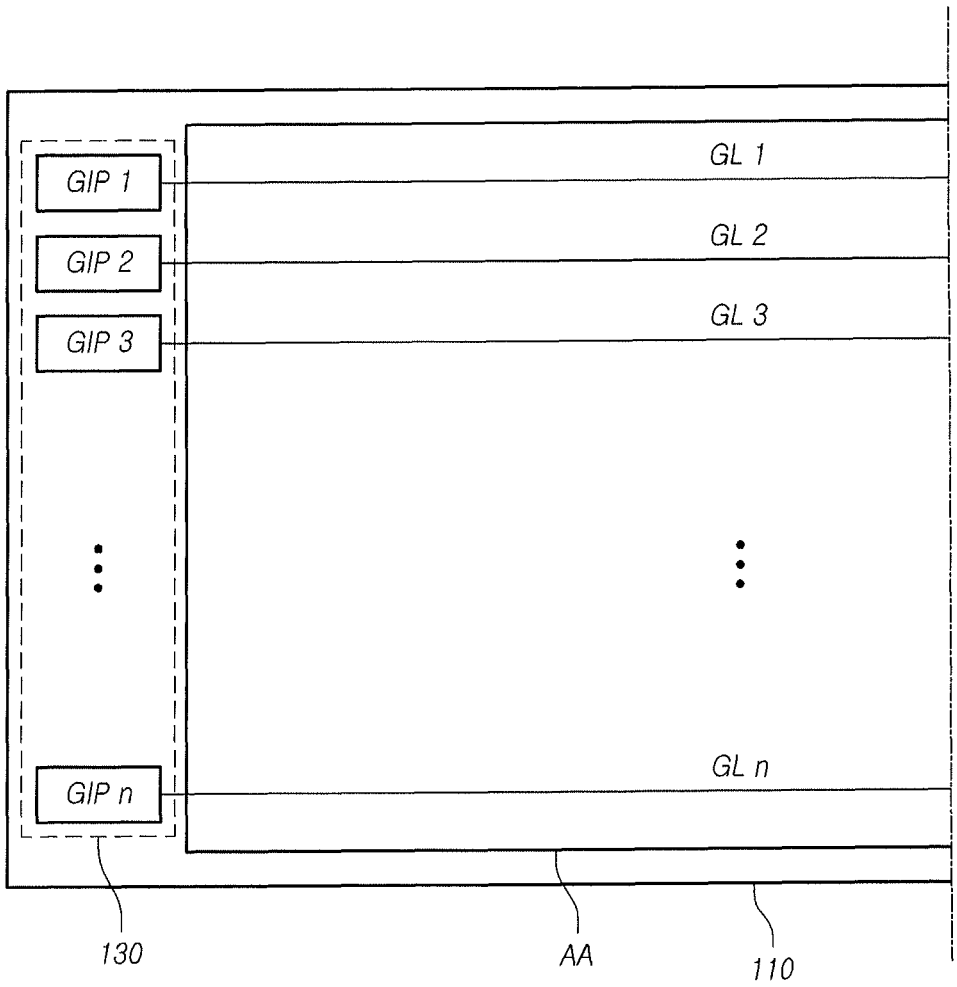
FIG. 2 is an example view illustrating a gate driving unit of the display device according to the present embodiments.

At this case, as illustrated in FIG. 2 which is an example view of the gate driving unit 130, the plurality of gate driving ICs GIP 1, GIP 2, . . . , and GIP n may be disposed in an outside area (i.e. a non-active area) of an Active Area (AA) which is a display area in the display panel 110. In FIG. 2, a number of the gate driving ICs is n which is equal to a number (i.e. n) of the gate lines. But, the number (e.g. 2n) of the gate driving ICs may be different from the number (i.e. n) of the gate lines, according to an implementation manner such as the gate driving manner (e.g. the double feeding manner).

The timing controller 140 controls a driving timing of the data driving unit 120 and the gate driving unit 130, and outputs various control signals for the control of the driving timing.

The display device 100 according to an exemplary embodiment may further include a system interface 150 outputting an image signal (i.e. image data), various signals and so on to the timing controller 140.

The display device 100 according to an exemplary embodiment, similarly to a normal gate driving manner, may scan with respect to all areas of the display panel 110 in order to display one frame, that is, the display device 100 may sequentially provide the scan signal to all of the n number of gate lines GL1 to GLn in order to display one frame. But, the display device 100 may perform a partial gate driving, differently from the normal gate driving manner, according to circumstances.

Here, the partial gate driving means scanning only a partial area of the display panel 110 in order to display one frame. That is, the partial gate driving means sequentially providing the scan signal to only a partial gate line among the n number of gate lines GL1 to GLn in order to display one frame.

In the partial gate driving, conceptually, when a frame is changed and an image change between a previous frame and a current frame is generated in only the partial area, a gate driving is performed with respect to only the partial area where the image change is generated, and the gate driving is not performed with respect to an area where the image change is not generated.

A screen division concept is suggested for the partial gate driving.

Figure 3:
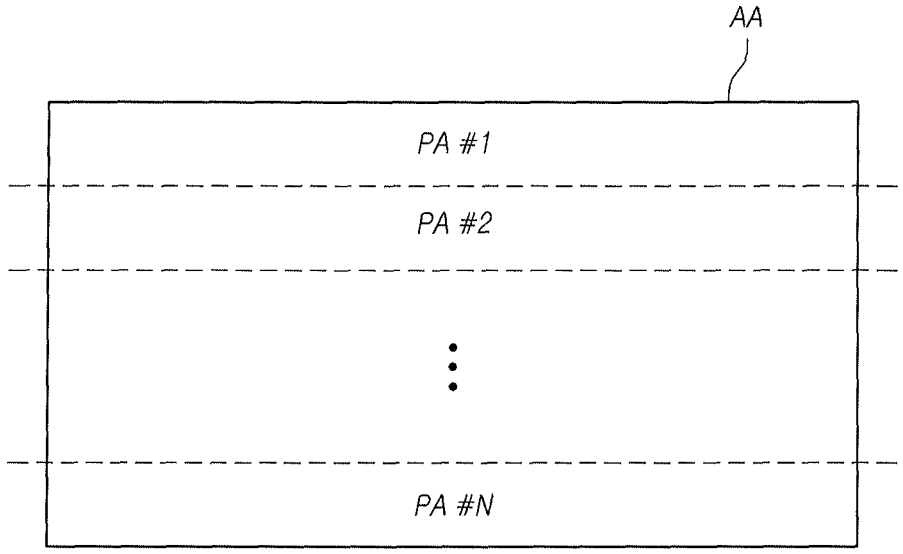
FIG. 3 is a view illustrating an active area and partial areas of the active area in a display panel of the display device according to the present embodiments.

FIG. 3 is a view illustrating the Active Area (AA) AA and Partial Areas (PAs) PA of the active area AA in the display panel 110 of the display device 100 according to an exemplary embodiment.

Referring to FIG. 3, in relation to the screen division for the partial gate driving, the Active Area (AA) corresponding to a display area where an image may be displayed in the display panel 110 is divided into two or more Partial Areas (PAs) PA #1, PA #2, . . . , PA #N (here, N≥2).

In each of the partial areas, two or more gate lines are formed.

For the partial gate driving, a new concept referred to as a virtual "Gate Driving Group (GDG: Gate Driver IC Group)", as an assembly (i.e a group) of the gate driving ICs respectively driving the partial areas, is suggested. The gate driving group is described with reference to FIG. 4.

Figure 4:
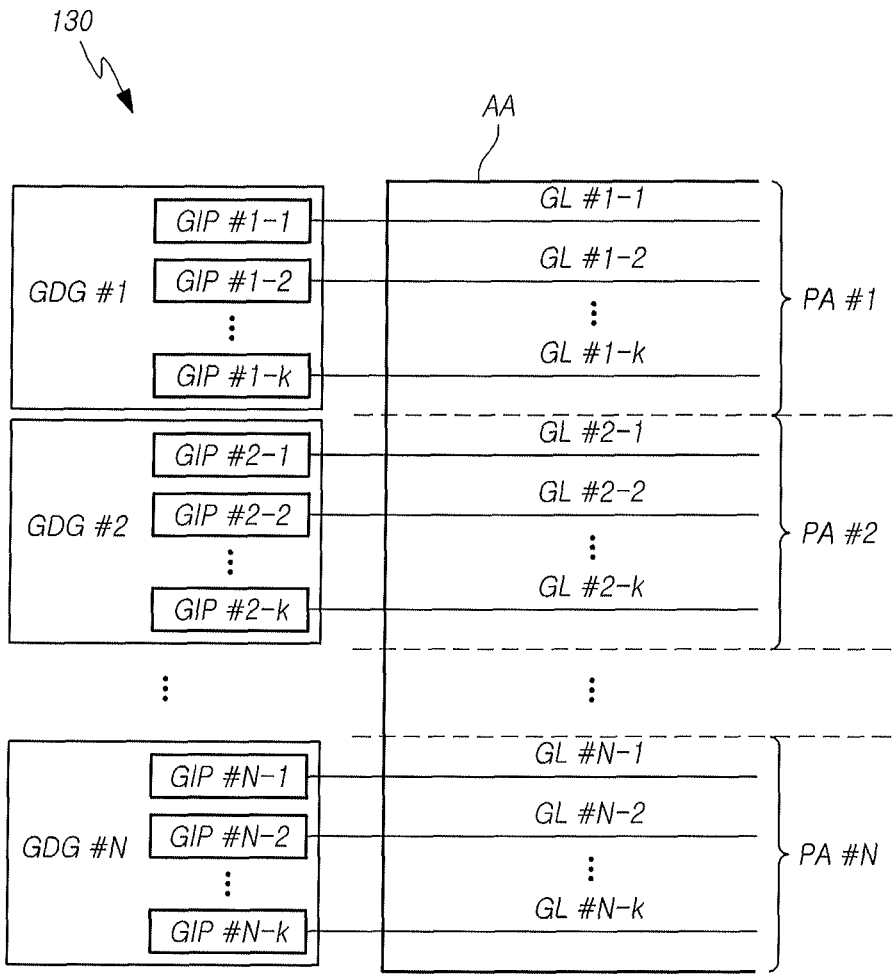
FIG. 4 is a view illustrating a groupage of gate driving integrated circuits for a partial gate driving of the display device according to the present embodiments.

FIG. 4 is a view illustrating a groupage of the gate driving ICs for the partial gate driving of the display device 100 according to an exemplary embodiment.

Referring to FIG. 4, the gate driving group is the assembly or the group of the two or more gate driving ICs.

One gate driving group includes two or more gate driving ICs, and corresponds to one partial area PA.

Thus, the two or more gate driving ICs included in one gate driving group output the scan signal to two or more gate lines GL formed in the corresponding partial area PA.

Referring to FIG. 4, when the n number of gate driving ICs are divided by k number and one gate driving group includes k number of gate driving ICs, the n number of gate driving ICs are divided into N number of gate driving groups GDG #1, GDG #2, . . . , and GDG #N (here, N<n and N*k=n).

Referring to FIG. 4, each of the N number of gate driving groups GDG #1, GDG #2, . . . , and GDG #N includes the k number of gate driving ICs GIP #i−1, GIP #i−2, . . . and GIP #i−k (here, 1≤i≤N).

For example, when 1080 gate driving ICs are divided by 270 and one gate driving group includes 270 gate driving ICs, the 1080 gate driving ICs divided into four gate driving groups GDG #1, GDG #2, GDG #3 and GDG #4, and each of the gate driving groups includes the 270 gate driving ICs GIP #i−1, GIP #i−2, . . . , and GIP #i−270 (here, 1≤i≤4).

Referring to FIG. 4, the N number of gate driving group GDG #1, GDG #2, . . . , and GDG #N correspond to N number of partial areas PA #1, PA #2, . . . , and PA #N, respectively.

In addition, k number of gate driving ICs GIP #i−1, GIP #i−2, . . . , and GIP #i−k (here, 1≤i≤N) included in each of the N number of gate driving group GDG #1, GDG #2, . . . , and GDG #N output the scan signal to gate lines formed in a corresponding partial area of the display panel 110.

For example, the gate driving group GDG #1 includes the k number of gate driving ICs GIP #i−1, GIP #i−2, . . . , and GIP #i−k, and the k number of gate driving ICs GIP #i−1, GIP #i−2, . . . , and GIP #i−k sequentially output the scan signal to k number of gate lines GL #1-1, GL #1-2, . . . , and GL #1-*k* formed in the partial area PA #1 corresponding to the gate driving group GDG #1.

Meanwhile, for the partial gate driving, the gate driving ICs included in each of the gate driving group should know whether the gate driving ICs are operated (i.e. a scan signal output) for driving a frame of this time.

Thus, a control signal should be input to a gate driving group to be operated among the N number of gate driving groups GDG #1, GDG #2, . . . , and GDG #N. Here, the control signal is for reporting an operation or non-operation of each of the N number of gate driving groups GDG #1, GDG #2, . . . , and GDG #N. That is, the control signal is for reporting whether the scan signal is output from the two or more gate driving ICs included in each of the N number of gate driving groups GDG #1, GDG #2, . . . , and GDG #N.

Figure 5:
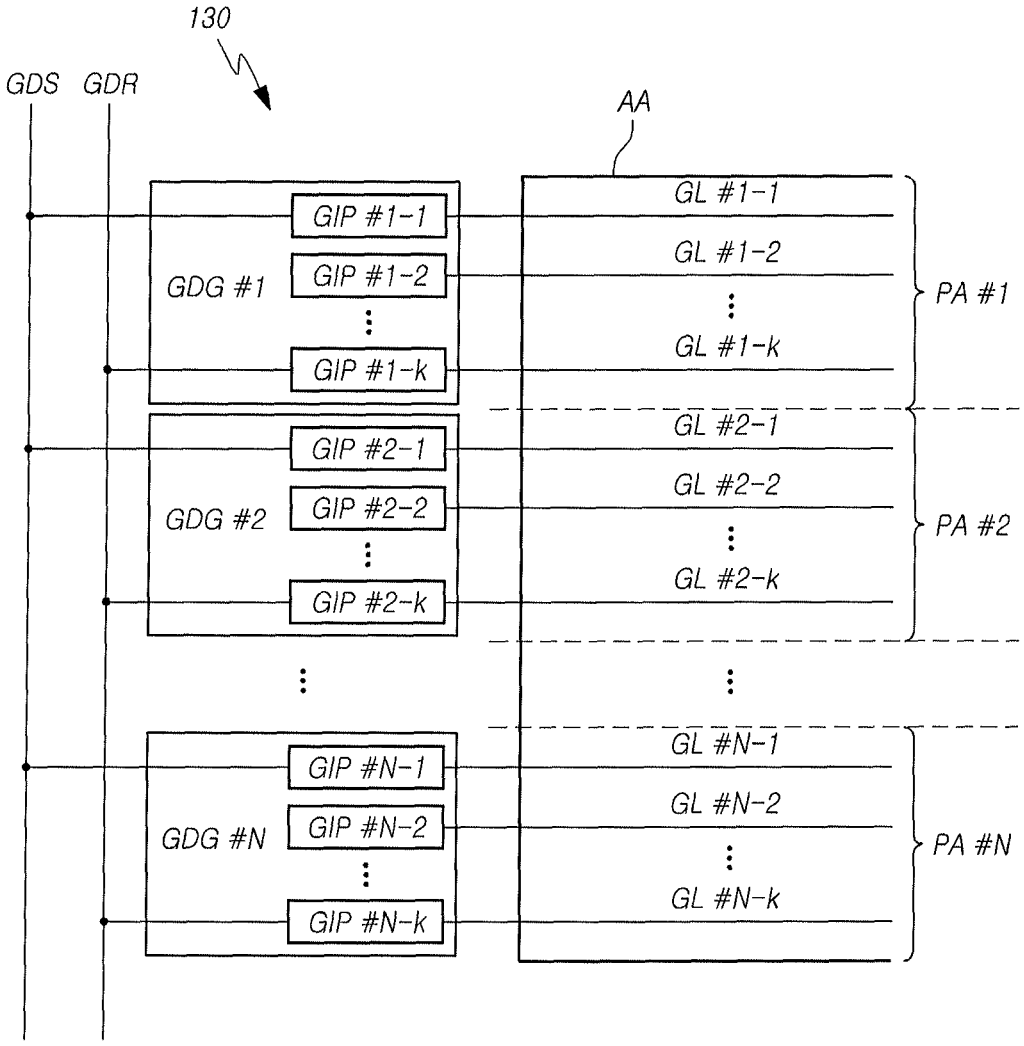
FIG. 5 is a view illustrating a control signal line for the partial gate driving of the display device according to the present embodiments.

FIG. 5 is a view illustrating a control signal line for the partial gate driving of the display device 100 according to an exemplary embodiment.

Referring to FIG. 5, the control signal for the partial gate driving, includes a Group Driving Start (GDS) signal GDS for reporting an operation start of a corresponding gate driving group, and a Group Driving Refresh (GDR) signal GDR for reporting an operation end of the corresponding gate driving group.

Referring to FIG. 5, the control signal line for inputting the control signals GDS and GDR to each of the gate driving groups may be formed in the display panel 110, so that the corresponding gate driving group receives the control signals GDS and GDR for the partial gate driving.

Referring to FIG. 5, the group driving start signal GDS of the control signals for the partial gate driving may be input to a first gate driving IC among the gate driving ICs included in each of the gate driving groups. In addition, the group driving refresh signal GDR of the control signals for the partial gate driving may be input to a last gate driving IC among the gate driving ICs included in each of the gate driving groups.

Thus, as shown in FIG. 5, the first gate driving IC among the gate driving ICs included in each of the gate driving groups is connected to a GDS signal line through which the group driving start signal GDS is transferred. The last gate driving IC among the gate driving ICs included in each of the gate driving groups is connected to a GDR signal line through which the group driving refresh signal GDR is transferred.

The timing control of the gate driving and the area control described above may be performed by the timing controller 140. That is, which gate driving group is operated (only which partial area is driven during one frame), and controls of an operation timing of the gate driving group to be operated and so on may be performed by the timing controller 140.

The timing controller 140 included in the display device 100 according to an exemplary embodiment controls to sequentially output the scan signal from two or more gate driving ICs included in the gate driving group selected for driving one frame among the two or more Gate Driving Groups (GDGs) partitively including the plurality of gate driving ICs.

The timing controller 140 may select at least one gate driving group, including the two or more gate driving ICs, to output the scan signal for driving a current frame, among the plurality of gate driving ICs, from the two or more gate driving groups, based on a comparison result of image data between the current frame to be displayed present and a previous frame displayed previously, and may control to output the scan signal from only the two or more gate driving ICs included in the selected gate driving group.

More specifically, the timing controller 140 may select at least one gate driving group, including the two or more gate driving ICs, outputting the scan signal to a gate line formed in an area where the image is changed, among the plurality of gate driving ICs, from the two or more gate driving groups, based on the comparison result of the image data between the current frame and the previous frame.

In relation to the output of the control signal for the partial gate driving, the timing controller 140 provides the group driving start signal GDS and the group driving refresh signal GDR to each of the gate driving groups selected among the two or more gate driving groups, and the timing controller further provides a gate start signal (VST) to at least one high rank gate driving group (when all of the gate driving groups are operated, a gate driving group including a gate driving IC first outputting the scan signal may be included and following one gate driving group may be further included) according to an ascending order driving sequence among the selected gate driving groups. Here, the gate start signal (VST) is a control signal applied to the first gate driving IC(s) in order to inform a start of the frame in a normal gate driving. In addition, the timing controller 140 may further provide a gate end signal (VEND) to at least one low rank gate driving group (when all of the gate driving groups are operated, a gate driving group including a gate driving IC last outputting the scan signal may be included and previous one gate driving group may be further included) according to a descending order driving sequence among the gate driving group selected among the two or more gate driving groups. Here, the gate end signal (VEND) is a control signal applied to the last gate driving IC(s) in order to inform an end of the frame in the normal gate driving.

According to the above, the group driving start signal GDS and the group driving refresh signal GDR are applied to each of the gate driving groups to be operated selected among all of the gate driving groups, unrelated to the gate start signal (VST) and the gate end signal (VEND) for reporting the start and end of the driving of one frame.

The timing controller 140 provides only one of the group driving start signal GDS and a gate start signal (VST) to at least one high rank gate driving group according to the ascending order driving sequence among the gate driving group selected among all of the gate driving groups. In addition, the timing controller 140 provides only one of the group driving refresh signal GDR and the gate end signal (VEND) to at least one low rank gate driving group according to the descending order driving sequence among the selected gate driving group. In addition, the timing controller 140 may provide the group driving start signal GDS and the group driving refresh signal GDR to each of a middle gate driving groups except for the high rank gate driving group and the low rank gate driving group among the selected gate driving group.

According to the above, the gate start signal (VST) and the gate end signal (VEND) for reporting the start and end of the driving of one frame are applied to the first gate driving group and the last gate driving group, respectively. Therefore, for the partial gate driving, when the first gate driving group is operated, the group driving start signal GDS may not be input to the first gate driving group, and the gate start signal (VST) may replace the group driving refresh signal GDR. In addition, for the partial gate driving, when the last gate driving group is operated, the group driving refresh signal GDR may not be input to the last gate driving group, and the gate end signal (VEND) may replace the group driving refresh signal GDR.

Meanwhile, at least one of an uppermost gate driving group of the high rank gate driving group and a lowermost gate driving group of the low rank gate driving group may further include at least one dummy gate driving IC. The dummy gate driving IC may receive the gate start signal (VST) and the gate end signal (VEND).

Hereinafter, an inside configuration of the timing controller 140 capable of controlling the partial gate driving is described with reference to FIG. 6.

Figure 6:
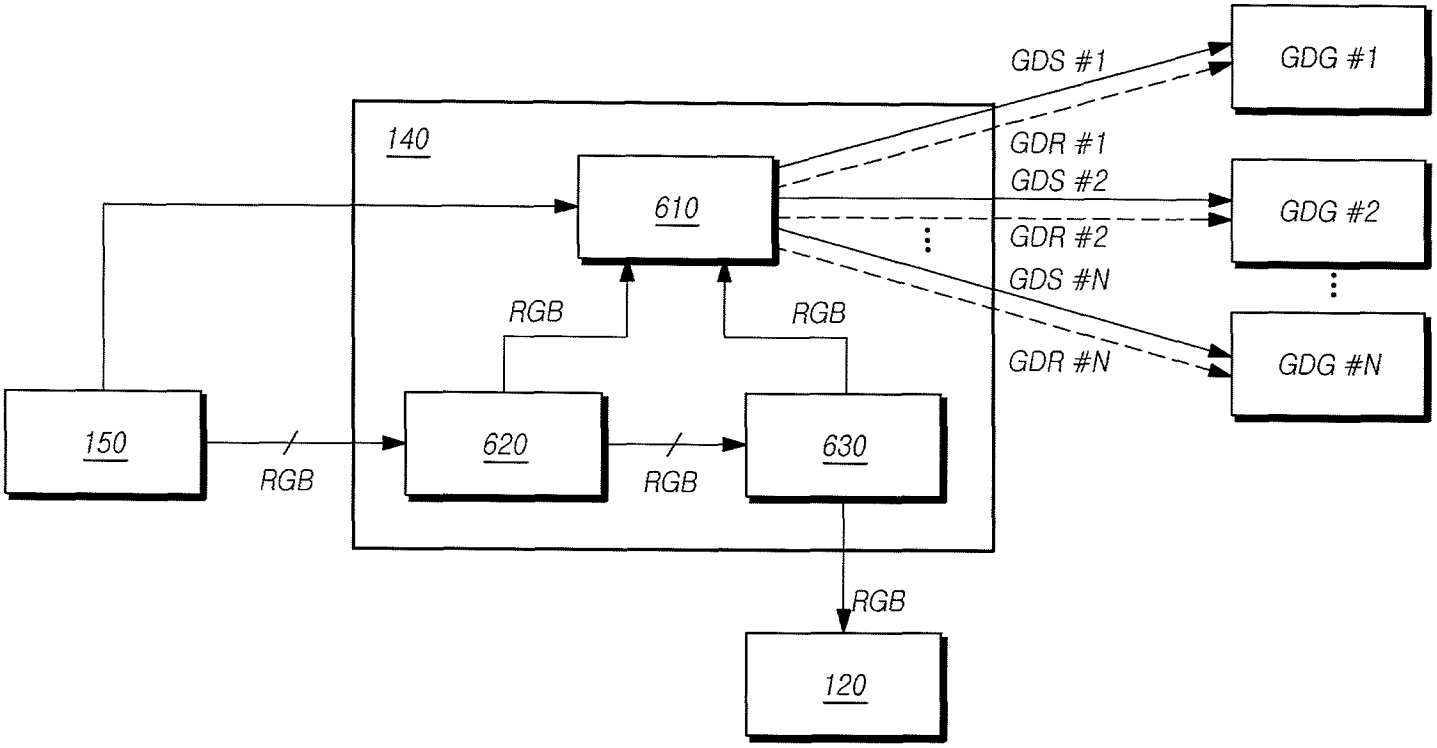
FIG. 6 is a view illustrating a timing controller for the partial gate driving of the display device according to the present embodiments, in detail.

FIG. 6 is a view illustrating the timing controller 140 for the partial gate driving of the display device 100 according to an exemplary embodiment, in detail.

Referring to FIG. 6, the timing controller 140 includes a first frame buffer 620, a second frame buffer 630, a control unit 610, etc. The first frame buffer 620 stores the image data of the current frame input from the system interface 150. The second frame buffer 630 receives the image data of the previous frame had been stored to the first frame buffer 620 and stores the image data of the previous frame, when image data RGB of a new current frame is input to the first frame buffer 620. The control unit 610 compares the image data of the previous frame stored to the second frame buffer 630 with the image data of the current frame stored to the first frame buffer 620, selects the gate driving group including the gate driving ICs to be operated in practice among the whole of the gate driving groups, and outputs the control signals GDS and GDR for the partial gate driving to the first gate driving IC and the last gate driving IC among the gate driving ICs included in the selected gate driving group, according to the selection result.

The control unit 610 of the timing controller 140 may control a timing so that a corresponding group driving start signal GDS is provided in correspondence to each of start time points respectively allocated to the selected gate driving groups, by equally allocating a frame driving time to each of the two or more gate driving groups.

At this time, the frame driving time of each of all frames is the same, unrelated to a number of the selected gate driving group. A driving time when the frame driving time is allocated to each of the selected gate driving group is equal to a pause time when the frame driving time is allocated to each of non-selected gate driving groups.

As another manner, the control unit 610 of the timing controller 140 may control a timing so that a corresponding group driving start signal GDS is provided in correspondence to each of start time points of a time allocated to each of the selected gate driving groups, by allocating a frame driving time to only the selected gate driving group.

At this time, the fewer the number of the selected gate driving group is, the shorter the frame driving time is.

FIGS. 7 to 11 are exemplary views illustrating the partial gate driving of the display device 100 according to an exemplary embodiment.

Figure 7:
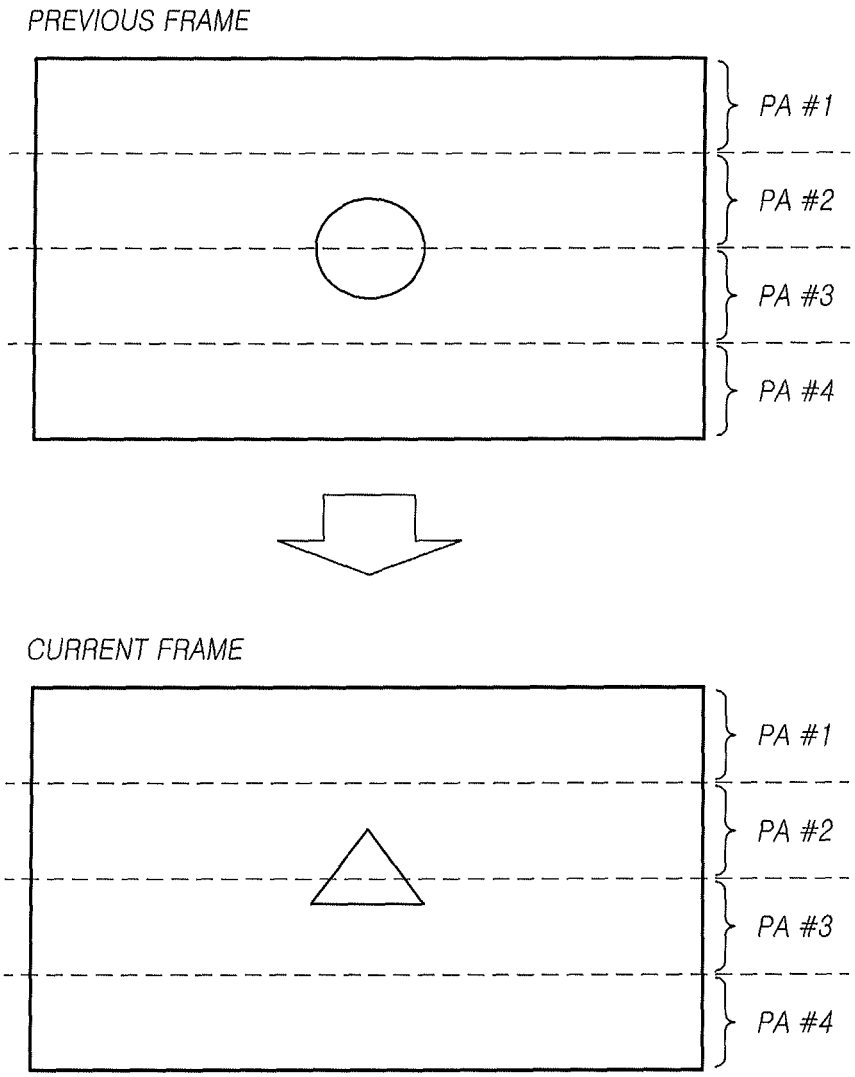
FIGS. 7 to 11 are example views illustrating the partial gate driving of the display device according to the present embodiments.

FIG. 7 is a concept view illustrating the previous frame and the current frame of which the image data are compared with each other, when the gate driving group is selected, for prefiguratively describing the partial gate driving method.

Referring to FIG. 7, in the current frame, the image change is generated in only two partial areas PA #2 and PA #3 among the four partial areas PA #1, PA #2, PA #3 and PA #4 which are generated by dividing the active area AA, in comparison to the previous frame.

The timing controller 140 recognizes the image change is generated in the two partial areas PA #2 and PA #3, and the image change is not generated in the two partial areas PA #1 and PA #4, through an image data comparison. The timing controller 140 selects the gate driving group including the gate driving ICs capable of outputting the scan signal to the gate line formed in the partial areas PA #2 and PA #3 where the image change is generated.

Here, for the partial gate driving, selecting the gate driving group to be operated in practice among all of the gate driving groups, is equal to selecting the gate driving ICs outputting the scan signal in practice among all of the gate driving ICs.

Next, the timing controller 140 outputs the group driving start signal GDS and the group driving refresh signal GDR which are two kinds of control signals for the partial gate driving to the first gate driving IC and the last gate driving IC included in each of the selected gate driving groups.

Figure 8:
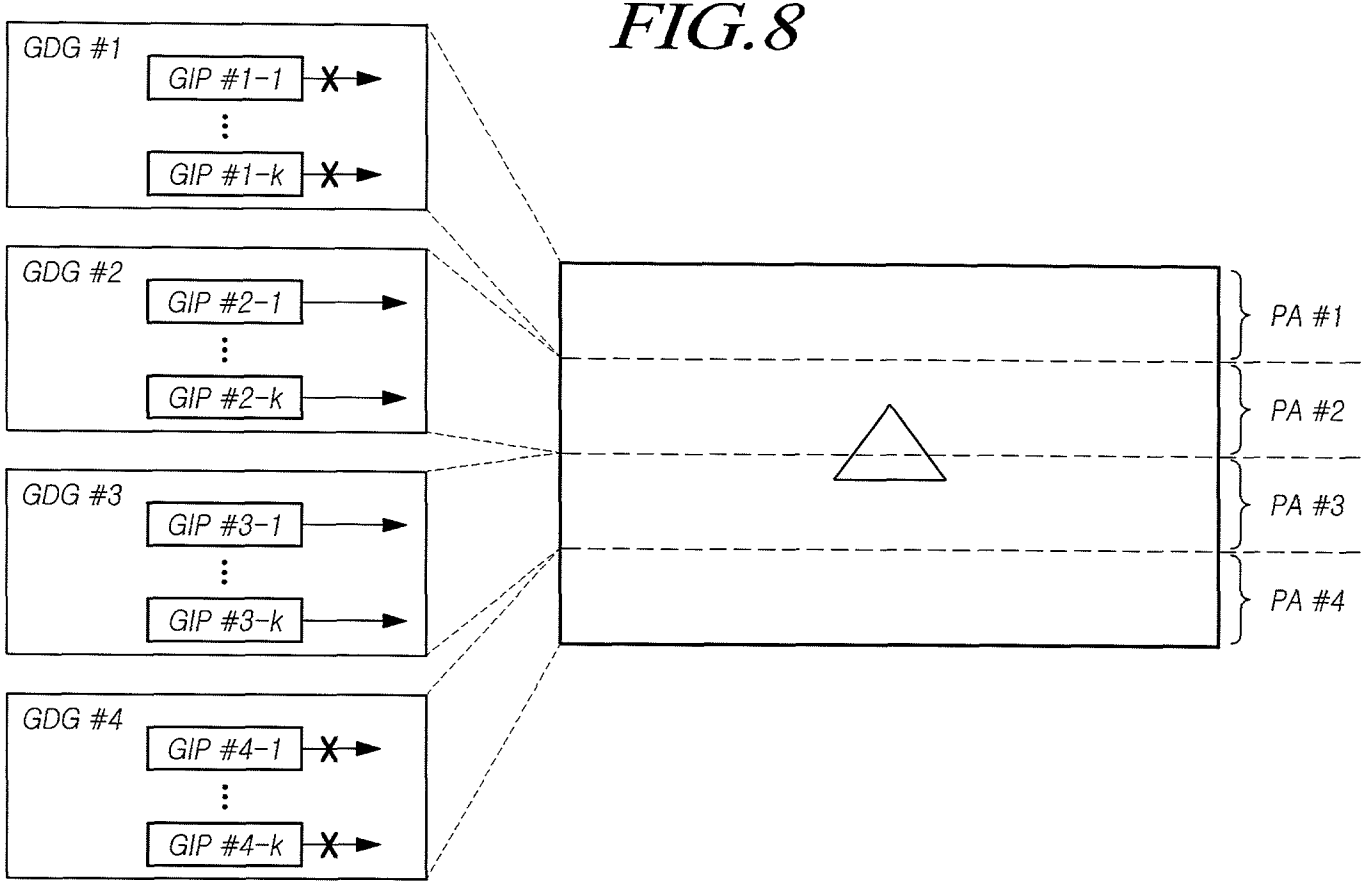

FIG. 8 is a view conceptually illustrating a performance of the gate line driving with respect to only the partial area due to an operation of a portion of all of the gate driving groups.

Referring to FIG. 8, the scan signal is sequentially output from only the gate driving ICs included in the gate driving groups GDG #2 and GDG #3 selected among the whole of the gate driving groups GDG #1, GDG #2, GDG #3 and GDG #4, and the scan signal is not output from the gate driving ICs included in rest of the gate driving groups GDG #1 and GDG #4, by the timing controller 140.

Thus, the driving is performed in only the two partial areas PA #2 and PA #3, which are checked as the partial areas where the image is changed, among the active area AA including the four partial areas PA #1, PA #2, PA #3 and PA #4.

Figure 9:
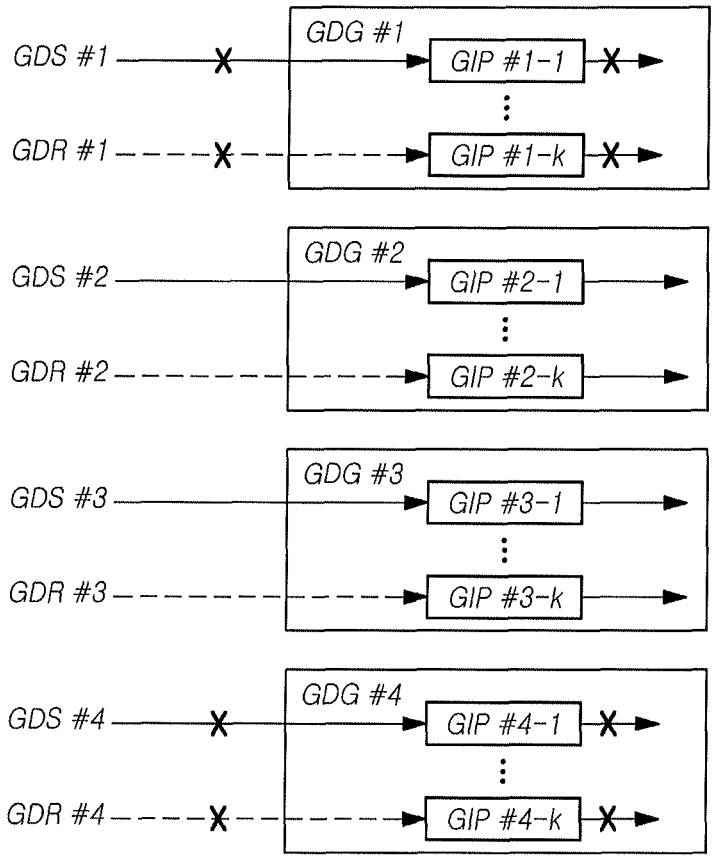

In FIG. 9, similarly to FIG. 8, the timing controller 140 outputs the group driving start signal GDS and the group driving refresh signal GDR to only each of the selected gate driving groups GDG #2 and GDG #3, so that the scan signal is sequentially output from only the gate driving ICs included in the gate driving groups GDG #2 and GDG #3 selected among the whole of the gate driving groups GDG #1, GDG #2, GDG #3 and GDG #4.

Figure 10:
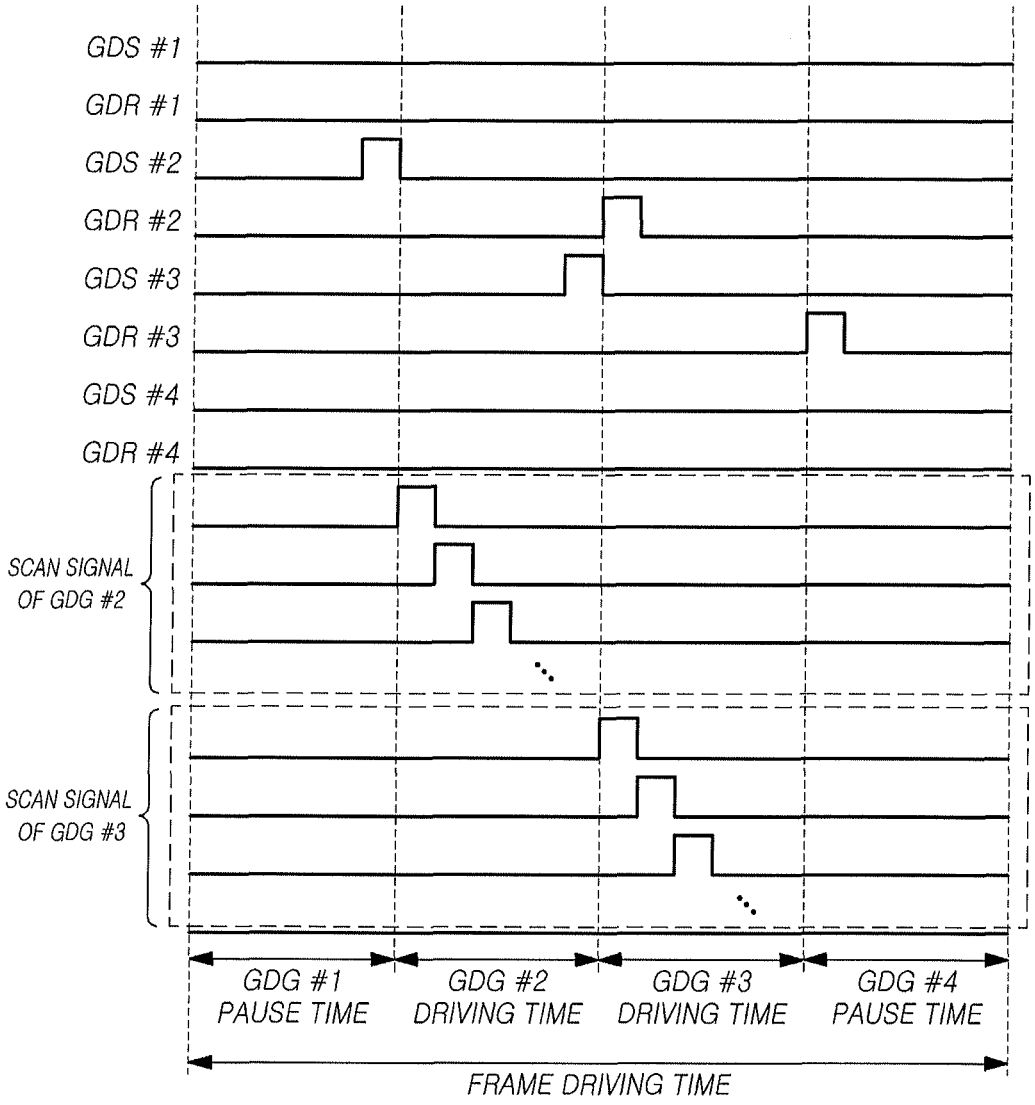
Figure 11:
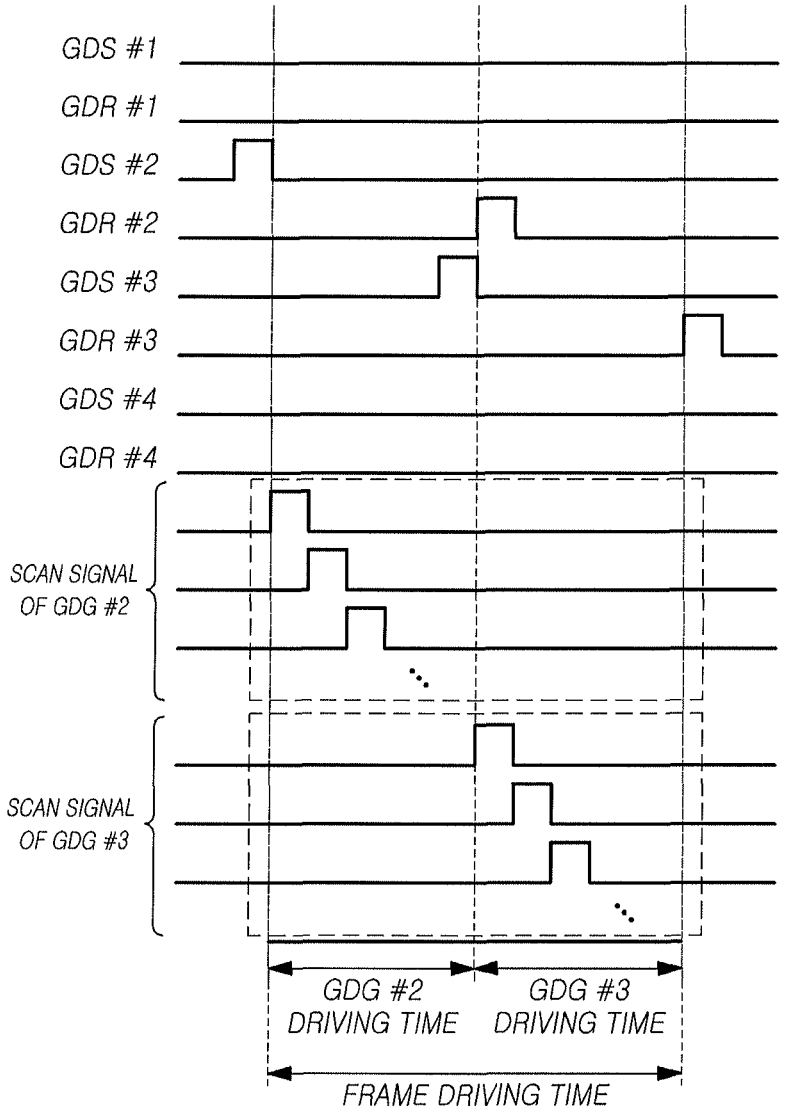

FIGS. 10 and 11 are two kinds of timing diagrams illustrating timings when the timing controller 140 outputs the group driving start signal GDS and the group driving refresh signal GDR to each of the selected gate driving groups GDG #2 and the GDG #3.

Referring to FIG. 10, the timing controller 140 equally allocates the frame driving time to each of the four gate driving groups GDG #1, GDG #2, GDG #3 and GDG #4. Thus, the times allocated to each of the four gate driving groups GDG #1, GDG #2, GDG #3 and GDG #4 are the same, and the frame driving time of each of all frames is the same.

Referring to FIG. 10, when a previous example is applied to FIG. 10, for the partial gate driving, the gate driving groups GDG #2 and GDG #3 are selected, therefore, a time allocated to the gate driving group GDG #2 is a GDG #2 driving time, a time allocated to the gate driving group GDG #3 is a GDG #3 driving time, a time allocated to the gate driving group GDG #1 is a GDG #1 pause time (i.e. a break time), and a time allocated to the gate driving group GDG #4 is a GDG #4 pause time (i.e. the break time).

Referring to FIG. 10, two or more gate driving ICs GIP #2-1, GIP #2-2, . . . included in the gate driving group GDG #2 sequentially output the scan signal, by a gate driving start signal GDS #2 provided to the gate driving group GDG #2. Next, two or more gate driving ICs GIP #3-1, GIP #3-2, . . . included in the gate driving group GDG #3 sequentially output the scan signal, by a gate driving refresh signal GDR #2 provided to the gate driving group GDG #2 and a gate driving refresh signal GDR #3 provided to the gate driving group GDG #3.

According to the timing control method of the timing controller 140 as shown in FIG. 10, the frame driving time may be unnecessarily longer, due to the GDG #1 pause time and the GDG #4 pause time.

A timing diagram according to the timing control method of the timing controller 140 for eliminating the above-mentioned problem is shown in FIG. 11.

Referring to FIG. 11, the timing controller 140, differently from the timing control method shown in FIG. 10, allocates the frame driving time to only the gate driving groups GDG #2 and GDG #3 selected among the whole of the gate driving groups GDG #1, GDG #2, GDG #3 and GDG #4, instead the timing controller 140 equally allocates the frame driving time to each of the whole of the gate driving groups GDG #1, GDG #2, GDG #3 and GDG #4.

The timing controller 140 may control a timing so that the corresponding group driving start signals GDS #2 and GDS #3 are provided in correspondence to each of start time points of the time allocated to each of the gate driving groups GDG #2 and GDG #3 selected among the whole of the gate driving groups GDG #1, GDG #2, GDG #3 and GDG #4.

At this time, the fewer the number of the selected gate driving group is, the shorter the frame driving time may be. Thus, the larger the partial area where the image is changed is, and the less a screen change is, the shorter a time taken for driving one frame is. Therefore, an unnecessary waste of time and the consequential power consumption may decrease.

The timing controller 140 may control the timing so that the corresponding group driving start signals GDS #2 and GDS #3 are provided in correspondence to each of the start time points of the time allocated to each of the gate driving groups GDG #2 and GDG #3 selected among the whole of the gate driving groups GDG #1, GDG #2, GDG #3 and GDG #4.

Figure 12A:
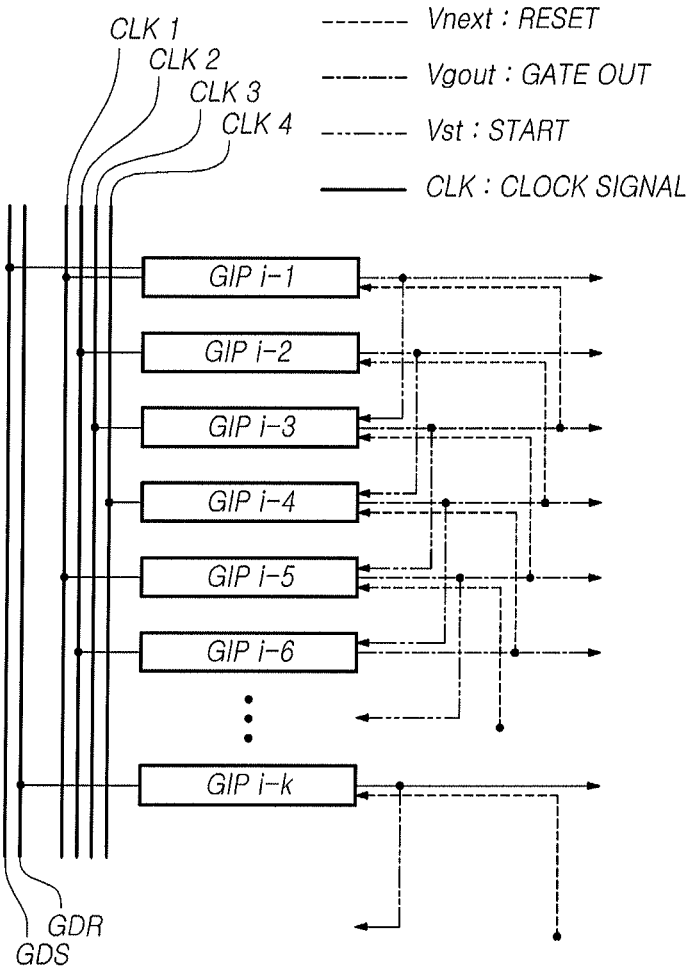
FIGS. 12A and 12B are example views for describing operations of the gate driving integrated circuits in a gate driving group for the partial gate driving of the display device according to the present embodiments.
Figure 12B:
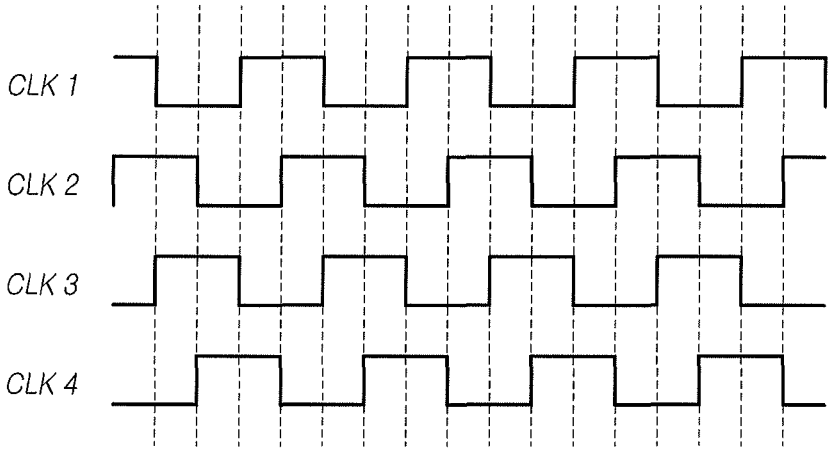

FIGS. 12A and 12B are example views for describing operations of the gate driving ICs GIP i−1, GIP i−2, . . . , and GIP i−k in the gate driving group GDG for the partial gate driving of the display device 100 according to an exemplary embodiment.

As shown in FIG. 12B, the (partial) gate driving may be performed in a four phase driving manner using four clock signals CLK1, CLK2, CLK3 and CLK4.

Referring to FIG. 12A, a gate driving IC GIP i−1 of a first stage in an ith gate driving group GDG #i receives a group driving start signal GDS #1 through the group driving start signal line GDS. Thus, a scan signal Vgout is sequentially output from the k number of gate driving ICs GIP #i−1, GIP #i−2, . . . , and GIP #i−k included in the ith gate driving group GDG #i.

Referring to FIGS. 12A and 12B, according to four phase driving manner, the scan signal Vgout, output from a gate driving IC of a jth stage is input to a gate driving IC of a (j+2)th stage as a driving start signal Vst, and simultaneously, is input to a gate driving IC of a (j−2)th as a reset signal Vnext.

Besides the four phase driving manner as shown in FIG. 12, the gate line may be driven in one of a two phase driving method, a six phase driving method, an eight phase driving method and so on.

Hereinafter, the partial gate driving of the display device 100 according to an exemplary embodiment as described above is schematically summarized.

When a concept of the gate driving group is not considered, the timing controller 140 controls to output the scan signal from the two or more gate driving ICs selected for driving one frame among the plurality of gate driving ICs.

The timing controller 140 may select the two or more gate driving IC, outputting the scan signal to the gate line formed in the area where the image is changed, among the plurality of gate driving ICs, through the comparison of the image data between the current frame and the previous frame.

The above-mentioned partial gate driving method includes a step (STEP 1) of selecting the portion or the whole of the gate driving groups for driving one frame among the two or more gate driving groups partitively including the plurality of gate driving ICs, and a step (STEP 2) of controlling to sequentially output the scan signal from the two or more gate driving ICs included in each of the selected gate driving groups.

In addition, the display panel 110 for the partial gate driving includes the gate lines GL1 to GLn formed in the first direction, the data lines DL1 to DLm formed in the second direction crossing the first direction, and the plurality of gate driving ICs (i.e. the gate driver ICs) disposed for providing the scan signal to the gate lines GL1 to GLn. Here, only the portion of the plurality of gate driving ICs may output the scan signal for driving one frame.

A partitive driving method and a partial driving method for effective gate driving have been described. Hereinafter, a gate driving grouping structure and a signal line structure that enable partitive driving for effective gate driving, and a partial driving method based on the same, will be illustratively described.

The display device 100, according to the present embodiments, includes the display panel 110 in which m data lines DL1, . . . , and DLm, and n gate lines GL1, . . . , and GLn are disposed, the data driving unit 120 that drives the m data lines DL1, . . . , and DLm, the gate driving unit 130 that drives the n gate lines GL1, . . . , and GLn and includes n gate driving integrated circuits GIP #1, . . . , and GIP #n, a timing controller 140 that controls the data driving unit 120 and the gate driving unit 130, and the like.

The n gate driving integrated circuits GIP #1, . . . , and GIP #n are separated based on M (a natural number greater than or equal to 2) entities and are classified into N (a natural number greater than or equal to 2) gate driving groups GDG #1, . . . and GDG #N (n=N×M, n denotes the number of gate lines, N denotes the number of gate driving groups, and M denotes the number of gate driving integrated circuits in a single gate driving group).

The N gate driving groups GDG #1, . . . , and GDG #N correspond to N partial areas PA #1, . . . , and PA #N of the display panel 110.

The N gate driving groups GDG #1, . . . , and GDG #N separately operate (executes a gate driving operation such as outputting a scan signal and the like), based on a group driving start signal and a group driving refresh signal.

As described above, through partitive driving of the display panel 110, a time for driving the entire display panel 110 may be reduced, and driving efficiency may be increased. Depending on cases, by driving a part of the display panel 110, driving efficiency may be dramatically increased and a driving time may be significantly reduced.

Hereinafter, it is assumed that n corresponding to the number of gate lines and the number of gate driving integrated circuits is 12, N corresponding to the number of partial areas and the number of gate driving groups is 3, and M corresponding to the gate driving integrated circuits included in a single gate driving group GDG is 4.

Figure 13A:
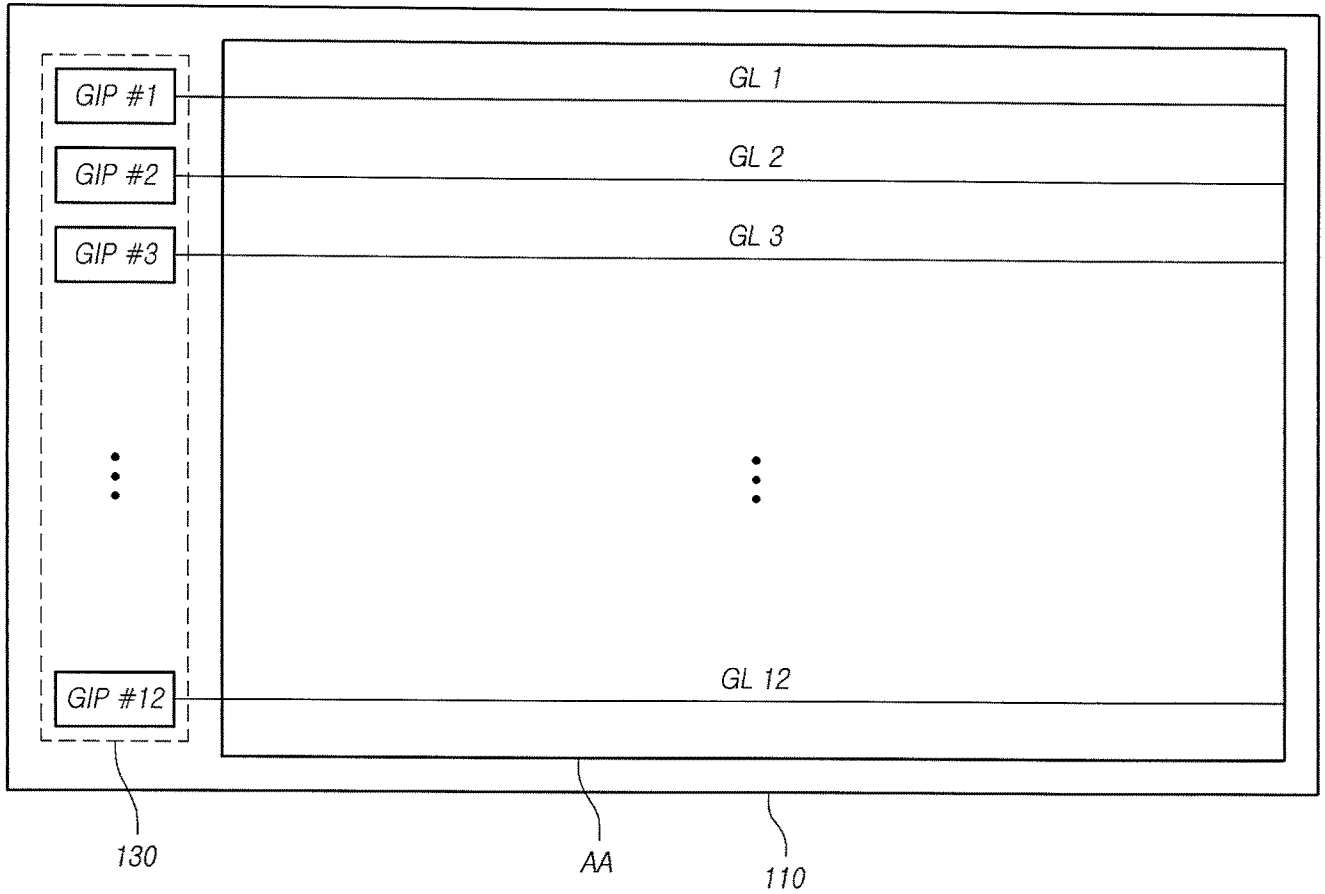
FIGS. 13A and 13B are example views illustrating a deployment of gate driving integrated circuits according to the present embodiments.
Figure 13B:
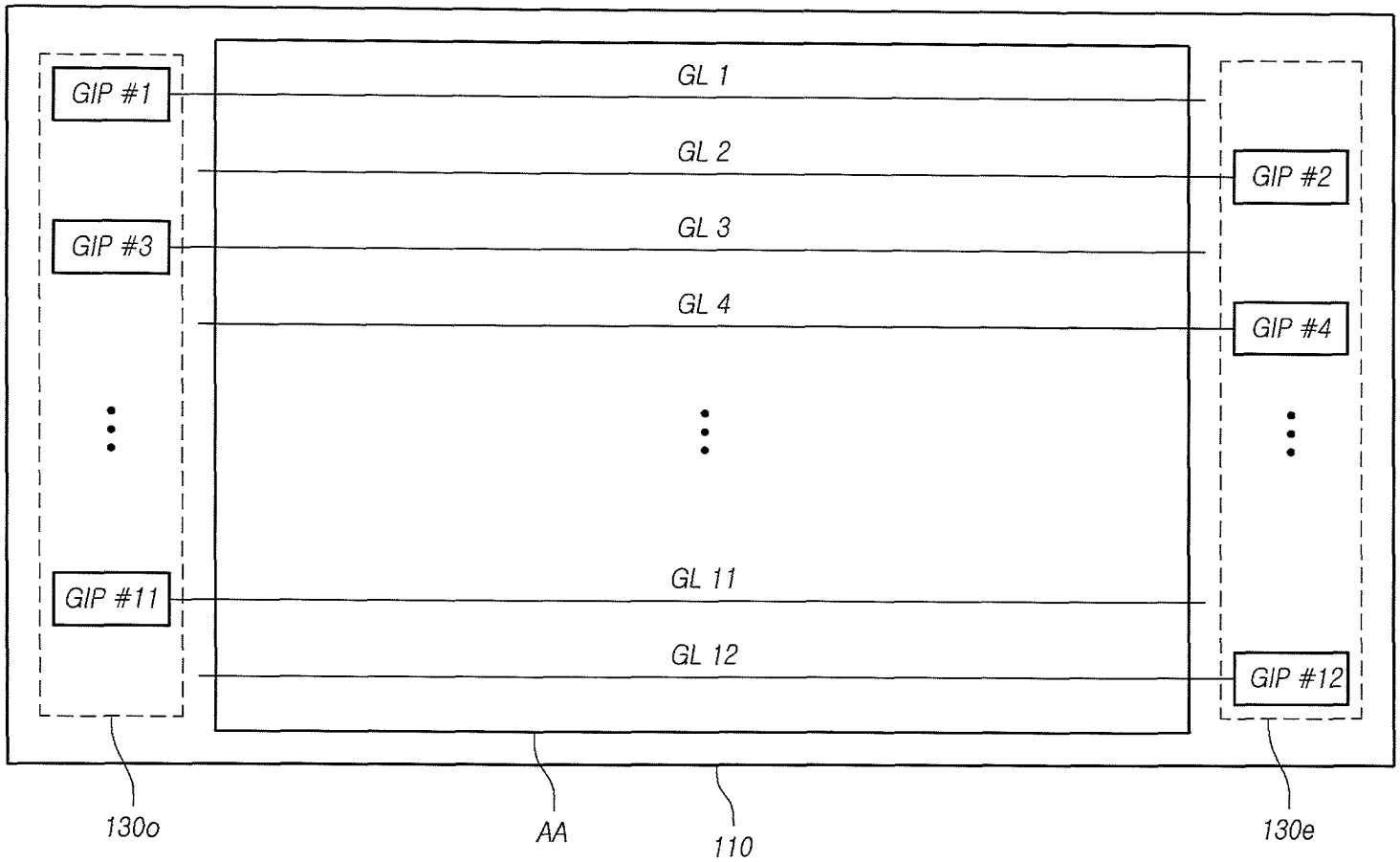

FIGS. 13A and 13B are example views illustrating a deployment of gate driving integrated circuits according to exemplary embodiments.

Referring to FIG. 13A, all of the 12 gate driving integrated circuits GIP #1, . . . , and GIP #12 that drive 12 gate lines GL1, . . . , and GL12 may be disposed in one side of the display panel 110.

Unlike the deployment of FIG. 13A, referring to FIG. 13B, the gate driving unit 130 may be divided as a gate driving unit 130*o* that is disposed in one side and drives odd-numbered gate lines GL1, GL3, . . . , and GL11, and a gate driving unit 130*e* that is disposed in the other side and drives even-numbered gate lines GL2, GL4, . . . , and GL2.

Referring to FIG. 13B, odd-numbered gate driving integrated circuits GIP #1, GIP #3, . . . , and GIP #11 of the 12 gate driving integrated circuits GIP #1, . . . , and GIP #12, which drive odd-numbered gate lines GL1, GL3, . . . , and GL11 of the 12 gate lines GL1, . . . , and GL12, are disposed in one side of the display panel 110.

Referring to FIG. 13B, even-numbered gate driving integrated circuits GIP #2, GIP #4, . . . , GIP #12 which drive even-numbered gate lines GL2, GL4, . . . , and GL12 of the 12 gate lines GL1, . . . , and GL12, may be disposed in the other side of the display panel 110.

The present specifications exemplify that the number of gate lines is identical to the number of gate driving integrated circuits, but depending on cases, the number of gate lines may be greater than the number of gate driving integrated circuits.

Hereinafter, for the deployment in one side of the gate driving unit 130 of FIG. 13A, and for the deployment in both sides of the gate driving unit 130 of FIG. 13B, a gate driving grouping structure and a signal line structure that enable partitive driving for effective gate driving, and a partial driving method based on the same will be illustratively described.

Figure 14:
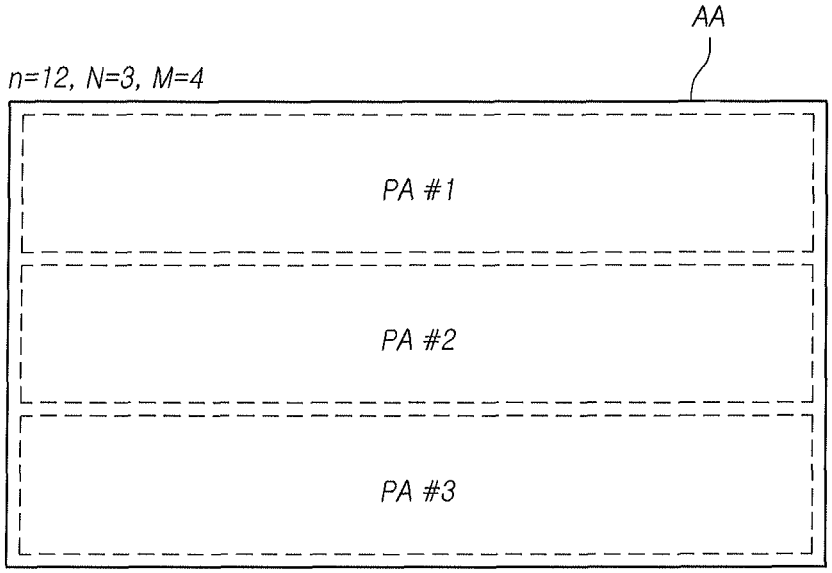
FIG. 14 is an example view of a display panel divided into three parts, for illustrating a gate driving grouping structure and a signal line structure that enable partitive driving, and a partial driving method based on the same, according to the present embodiments.

FIG. 14 is an example view of the display panel 110 divided into three parts, for illustrating a gate driving grouping structure and a signal line structure that enable partitive driving, and a partial driving method based on the same, according to the present embodiments.

Referring to FIG. 14, an Active Area (AA) where an image is displayed on the display panel 110 may be divided into three partial areas PA #1, PA #2, and PA #3.

Figure 15A:
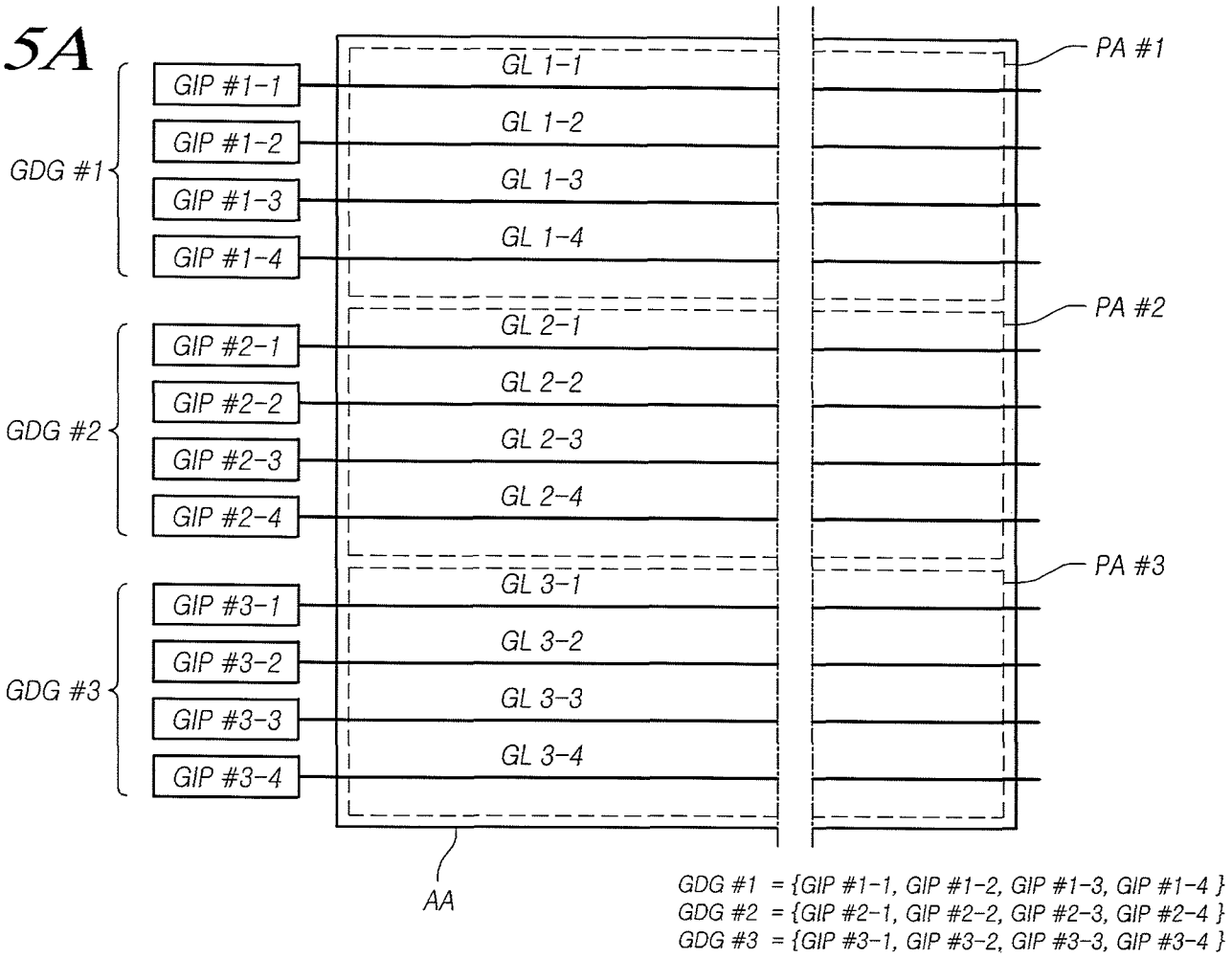
FIG. 15A is an example view of a gate driving group for partitive driving, under the deployment of gate driving integrated circuits of FIG. 13A.

FIG. 15A is an example view of three gate driving groups GDG #1, GDG #2, and GDG #3 for partitive driving, under the deployment (the deployment in one side) of 12 gate driving integrated circuits GIP #1, . . . , and GIP #12 of FIG. 13A.

Referring to FIG. 15A, the 12 gate driving integrated circuits GIP #1, GIP #2, . . . , and GIP #12 are grouped into three gate driving groups GDG #1, GDG #2, and GDG #3, each group including four circuits.

Accordingly, GDG #1 is a gate driving group that drives PA #1, and includes GIP #1, GIP #2, GIP #3, and GIP #4. GDG #2 is a gate driving group that drives PA #2, and includes GIP #5, GIP #6, GIP #7, and GIP #8. GDG #3 is a gate driving group that drives PA #3, and includes GIP #9, GIP #1*o*, GIP #11, and GIP #12.

Referring to FIG. 15A, for ease of description, a form of a GIP identifier given after "GIP" is changed from "#number" to "number (GDG identifier)–number (GIP identifier in GDG).

That is, GIP #1, GIP #2, GIP #3, and GIP #4 included in GDG #1 will be specified as GIP #1-1, GIP #1-2, GIP #1-3, and GIP #1-4, GIP #5, GIP #6, GIP #7, and GIP #8 included in GDG #2 will be specified as GIP #2-1, GIP #2-2, GIP #2-3, and GIP #2-4, and GIP #9, GIP #10, GIP #11, and GIP #12 included in GDG #3 will be specified as GIP #3-1, GIP #3-2, GIP #3-3, and GIP #3-4.

Figure 15B:
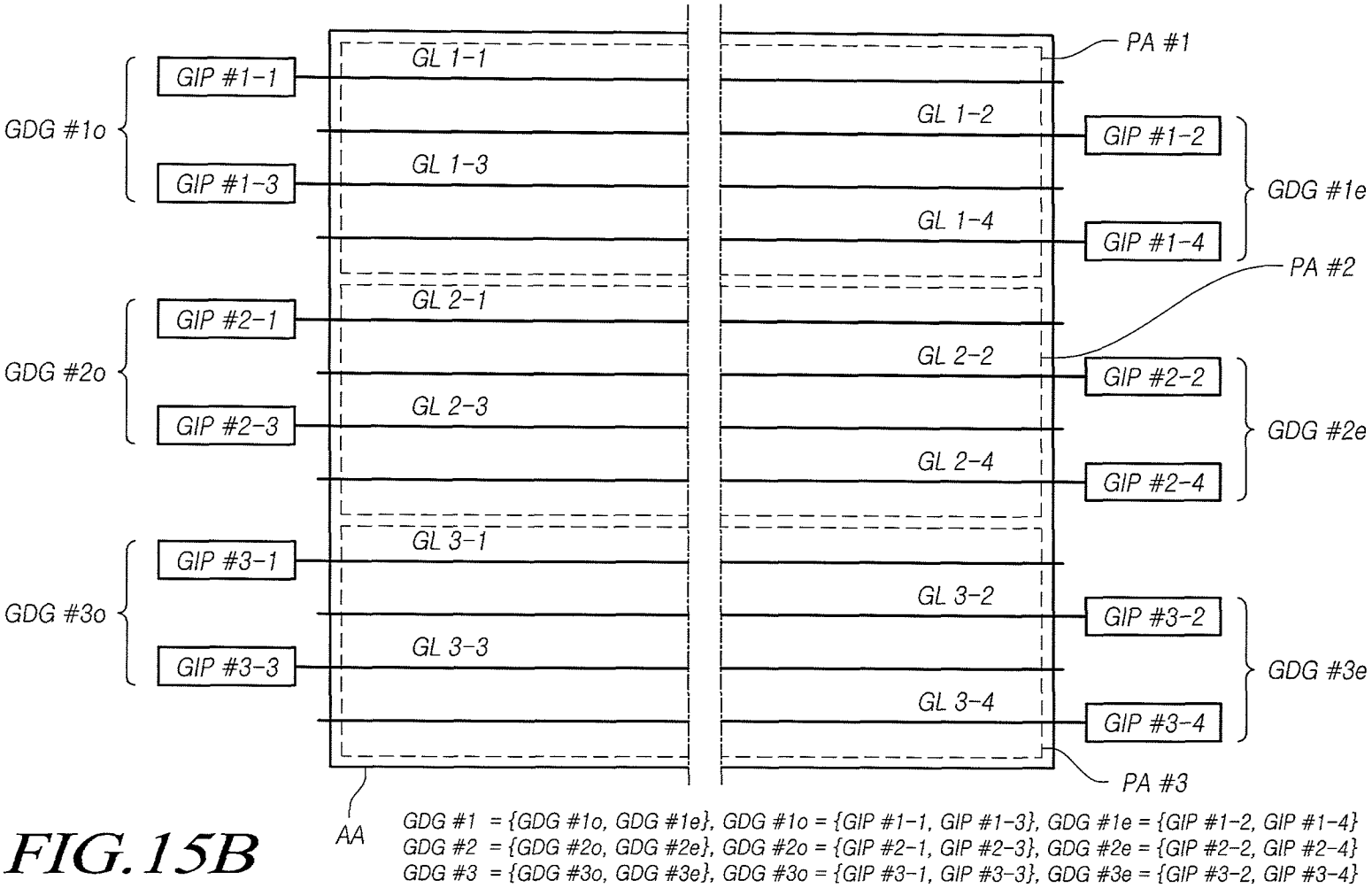
FIG. 15B is an example view of a gate driving group for partitive driving, under the deployment of gate driving integrated circuits of FIG. 13B.

FIG. 15B is an example view of three gate driving groups GDG #1, GDG #2, and GDG #3 for partitive driving, under the deployment (the deployment in both sides) of 12 gate driving integrated circuits GIP #1, . . . , and GIP #12 of FIG. 13B.

Referring to FIG. 15B, each of the three gate driving groups GDG #1, GDG #2, and GDG #3 includes an odd-numbered gate driving group including odd-numbered gate driving integrated circuits and an even-numbered gate driving group including even-numbered gate driving integrated circuits.

In more particular, GDG #1 includes an odd-numbered gate driving group GDG #1*o* including odd-numbered gate driving integrated circuits GIP #1-1 and GIP #1-3 that drive odd-numbered gate lines GL 1-1 and GL 1-3 in PA #1, and an even-numbered gate driving group GDG #1*e* including even-numbered gate driving integrated circuits GIP #1-2 and GIP #1-4 that drive even-numbered gate lines GL 1-2 and GL 1-4 in PA #1.

GDG #2 includes an odd-numbered gate driving group GDG #2*o* including odd-numbered gate driving integrated circuits GIP #2-1 and GIP #2-3 that drive odd-numbered gate lines GL 2-1 and GL 2-3 in PA #2, and an even-numbered gate driving group GDG #2*e* including even-numbered gate driving integrated circuits GIP #2-2 and GIP #2-4 that drive even-numbered gate lines GL 2-2 and GL 2-4 in PA #2.

GDG #3 includes an odd-numbered gate driving group GDG #3*o* including odd-numbered gate driving integrated circuits GIP #3-1 and GIP #3-3 that drive odd-numbered gate lines GL 3-1 and GL 3-3 in PA #3, and an even-numbered gate driving group GDG #3*e* including even-numbered gate driving integrated circuits GIP #3-2 and GIP #3-4 that drive even-numbered gate lines GL 3-2 and GL 3-4 in PA #3.

Figure 16A:
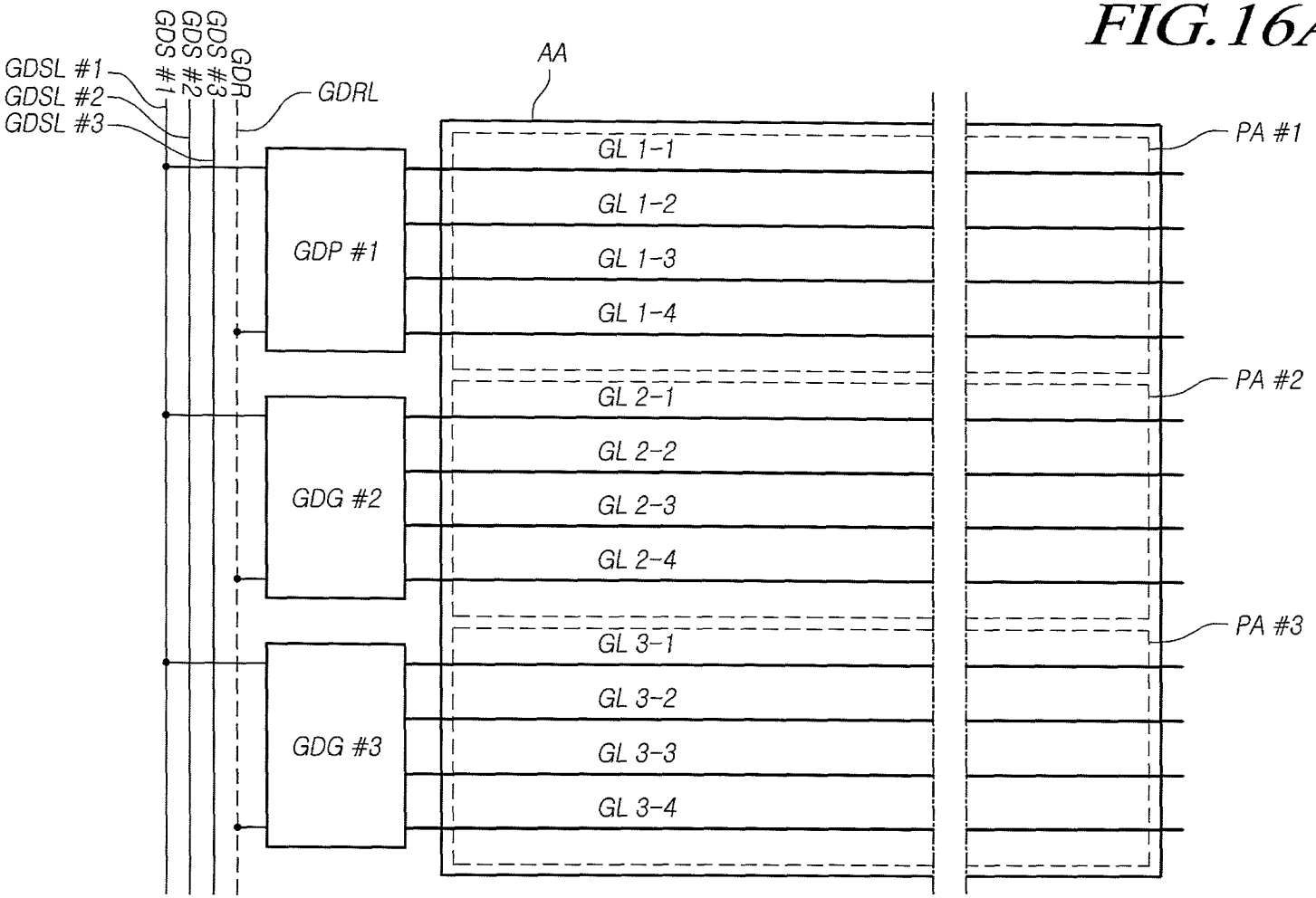
FIG. 16A is an example view of a signal line structure for partitive driving, under the gate driving grouping structure of FIG. 15A.

FIG. 16A is an example view of a signal line structure for partitive driving, under the gate driving grouping structure of FIG. 15A.

Referring to FIG. 16, to provide a corresponding group driving start signals GDS #1, GDS #2, and GDS #3 to each of three gate driving groups GDG #1, GDG #2, and GDG #3, three group driving start signal lines GDSL #1, GDSL #2, and GDSL #3 may be disposed in correspondence to the three gate driving groups GDG #1, GDG #2, and GDG #3.

Referring to FIG. 16A, that is, GDS #1 is provided to GDG#1 (for example, GIP #1-1 included in GDG #1) through GDSL #1. GDS #2 is provided to GDG#2 (for example, GIP #2-1 included in GDG #2) through GDSL #2. GDS #3 is provided to GDG#3 (for example, GIP #3-1 included in GDG #3) through GDSL #3.

Referring to FIG. 16A, to provide a single group driving refresh signal (GDR) corresponding to the three gate driving groups GDG #1, GDG #2, and GDG #3, a single group driving refresh signal line (GDRL) may be disposed.

Unlike FIG. 16A, to provide three group driving refresh signals respectively corresponding to the three gate driving groups GDG #1, GDG #2, and GDG #3, three group driving refresh signal lines may be disposed.

When the signal line structure as described above is used, a start and an end of driving of each of the three gate driving groups GDG #1, GDG #2, and GDG #3 may be accurately and independently controlled.

Figure 16B:
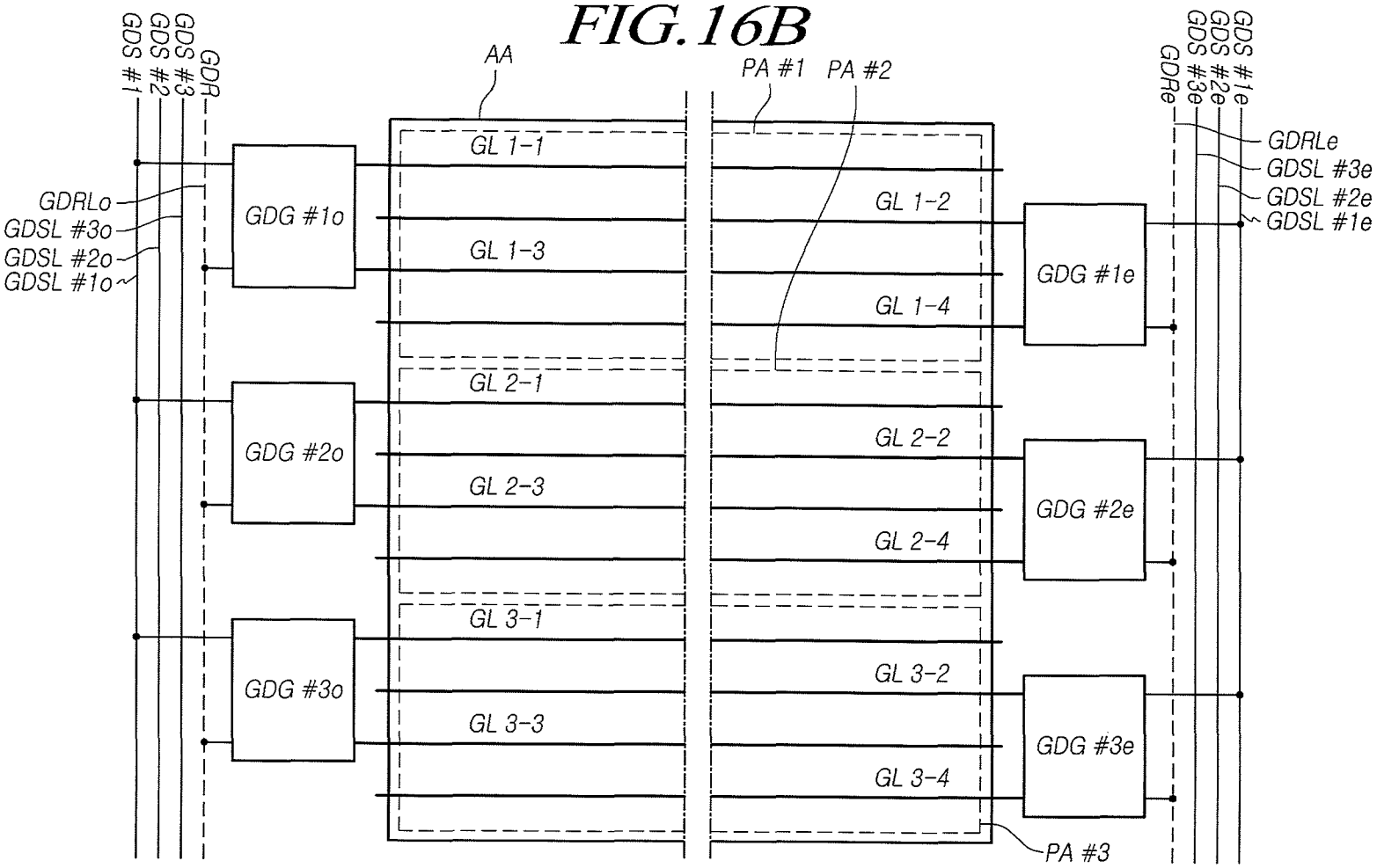
FIG. 16B is an example view of a signal line structure for partitive driving, under the gate driving grouping structure of FIG. 15B.

FIG. 16B is an example view of a signal line structure for partitive driving, under the gate driving grouping structure of FIG. 15B.

Referring to FIG. 16B, each of the three gate driving groups GDG #1, GDG #2, and GDG #3 includes an odd-numbered gate driving group including odd-numbered gate driving integrated circuits and an even-numbered gate driving group including even-numbered gate driving integrated circuits.

Referring to FIG. 16B, GDG #1 includes an odd-numbered gate driving group GDG #1*o* including GIP #1-1 and GIP #1-3, and an even-numbered gate driving group GDG #1*e* including GIP #1-2 and GIP #1-4. GDG #2 includes an odd-numbered gate driving group GDG #2*o* including GIP #2-1 and GIP #2-3, and an even-numbered gate driving group GDG #2*e* including GIP #2-2 and GIP #2-4. GDG #3 includes an odd-numbered gate driving group GDG #3*o* including GIP #3-1 and GIP #3-3, and an even-numbered gate driving group GDG #3*e* including GIP #3-2 and GIP #3-4.

Referring to FIG. 16B, to provide group driving start signals GDS #1*o*, GDS #2*o*, and GDS #3*o* corresponding to odd-numbered gate driving groups GDG #1*o*, GDG #2*o*, and GDG #3*o*, and group driving start signals corresponding to even-numbered gate driving groups GDG #1*e*, GDG #2*e*, and GDG #3*e*, respectively, with respect to three gate driving groups GDG #1, GDG #2, GDG #3, 2×3 group driving start signal lines GDSL #1*o*, GDSL #2*o*, GDSL #3*o*, GDSL #1*e*, GDSL #2*e*, and GDSL #3*e* may be disposed.

That is, GDS #1*o* may be provided to GDG #1*o* of GDG #1 through GDSL #1*o*, and GDS #1*e* is provided to GDG #1*e* of GDG #1 through GDSL #1*e*. GDS #2*o* may be provided to GDG #2*o* of GDG #2 through GDSL #2*o*, and GDS #2*e* is provided to GDG #2*e* of GDG #2 through GDSL #2*e*. GDS #3*o* may be provided to GDG #3*o* of GDG #3 through GDSL #3*o*, and GDS #3*e* is provided to GDG #3*e* of GDG #3 through GDSL #3*e*. GDS #4*o* may be provided to GDG #4*o* of GDG #4 through GDSL #4*o*, and GDS #4*e* is provided to GDG #4*e* of GDG #4 through GDSL #4*e*.

Referring to FIG. 16B, to provide a group driving refresh signal (GDRo) corresponding to odd-numbered gate driving groups GDG #1*o*, GDG #2*o*, and GDG #3*o* and a group driving refresh signal (GDRe) corresponding to even-numbered gate driving groups GDG #1*e*, GDG #2*e*, and GDG #3*e*, respectively, with respect to three gate driving groups GDG #1, GDG #2, and GDG #3, two group driving refresh signal lines GDRLo and GDRLe may be disposed.

Unlike FIG. 16B, to provide group driving refresh signals (GDRo) respectively corresponding to odd-numbered gate driving groups GDG #1*o*, GDG #2*o*, and GDG #3*o* and group driving refresh signals (GDRe) respectively corresponding to even-numbered gate driving groups GDG #1*e*, GDG #2*e*, and GDG #3*e*, respectively, with respect to three gate driving groups GDG #1, GDG #2, and GDG #3, 2×3 group driving refresh signal lines may be disposed.

When the signal line structure as described above is used, a start and an end of driving of each of the three gate driving groups GDG #1, GDG #2, and GDG #3 may be accurately and independently controlled, under odd/even gate driving scheme.

Figure 17A:
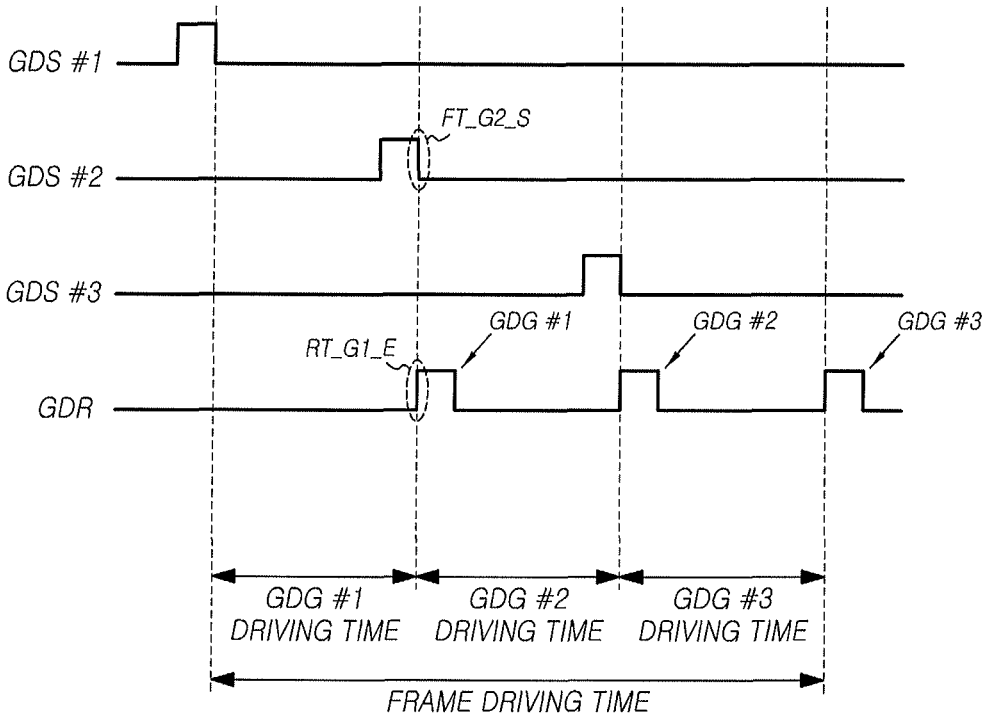
FIG. 17A is a timing diagram of a group driving start signal and a group driving refresh signal, under the signal line structure of FIG. 16A.

FIG. 17A is a timing diagram of three group driving start signals GDS #1, GDS #2, and GDS #3, respectively provided to three gate driving groups GDG #1, GDG #2, and GDG #3, and a group driving refresh signal GDR, under the signal line structure of FIG. 16A.

Referring to FIG. 17A, to report a start of gate driving of each of the three gate driving groups GDG #1, GDG #2, and GDG #3, three group driving start signals GDS #1, GDS #2, and GDS #3 may be provided to three gate driving groups GDG #1, GDG #2, and GDG #3, respectively.

That is, GDS #1 is a control signal that reports the start of gate driving of GDG #1, and is provided to GIP #1-1 of GDG #1. GDS #2 is a control signal that reports the start of gate driving of GDG #2, and is provided to GIP #2-1 of GDG #2. GDS #3 is a control signal that reports the start of gate driving of GDG #3, and is provided to GIP #3-1 of GDG #3.

Referring to FIG. 17A, a group driving refresh signal GDR is a control signal that reports an end of gate driving of each of the three gate driving groups GDG #1, GDG #2, and GDG #3, and a signal level is changed (LOW→HIGH or HIGH→LOW) at an end timing of gate driving of each of the three gate driving groups GDG #1, GDG #2, and GDG #3.

In the example of FIG. 17A, the group driving refresh signal GDR is maintained in a low level (LOW) before an end timing of gate driving of GDG#1, and is changed to a high level (HIGH) at the end timing, and then falls to a low level and is maintained before an end timing of gate driving of GDG#2, and is changed to a high level (HIGH) again at the end timing, and then falls to a low level (LOW) and is maintained before an end timing of gate driving of GDG #3, and is changed to a high level (HIGH) again at the end timing, and then falls to a low level (LOW) and is maintained.

Although the group driving refresh signal GDR has a signal waveform that rises at the end timing of gate driving of each of the three gate driving groups GDG #1, GDG #2, and GDG #3 in the example of FIG. 17A, the GDR may have a signal waveform that falls at the end timing of gate driving of each of the three gate driving groups GDG #1, GDG #2, and GDG #3.

Referring to FIG. 17A, a falling timing (for example, FT_G2_S) of a group driving start signal (for example, GDS #2) corresponding to an $i^{th}$ gate driving group (for example, GDG #2) may correspond to a rising timing (for example, RT_G1_E) of a group driving refresh signal GDR corresponding to an $i-1^{th}$ gate driving group (for example, GDG #1).

Unlike FIG. 17A, a rising timing of the group driving start signal (for example, GDS #2) corresponding to the $i^{th}$ gate driving group (for example, GDG #2) may correspond to a falling timing of the group driving refresh signal GDR corresponding to the $i-1^{th}$ gate driving group (for example, GDG #1).

Referring to FIG. 17A, a driving time of GDG #1 is a time from a falling timing (or a rising timing) of GDS #1 to a rising timing (or a falling timing) of GDR corresponding to the GDG #1. A driving time of GDG #2 is a time from a falling timing (or a rising timing) of GDS #2 to a rising timing (or a falling timing) of GDR corresponding to the GDG #2. A driving time of GDG #3 is a time from a falling timing (or a rising timing) of GDS #3 to a rising timing (or a falling timing) of GDR corresponding to the GDG #3.

Figure 17B:
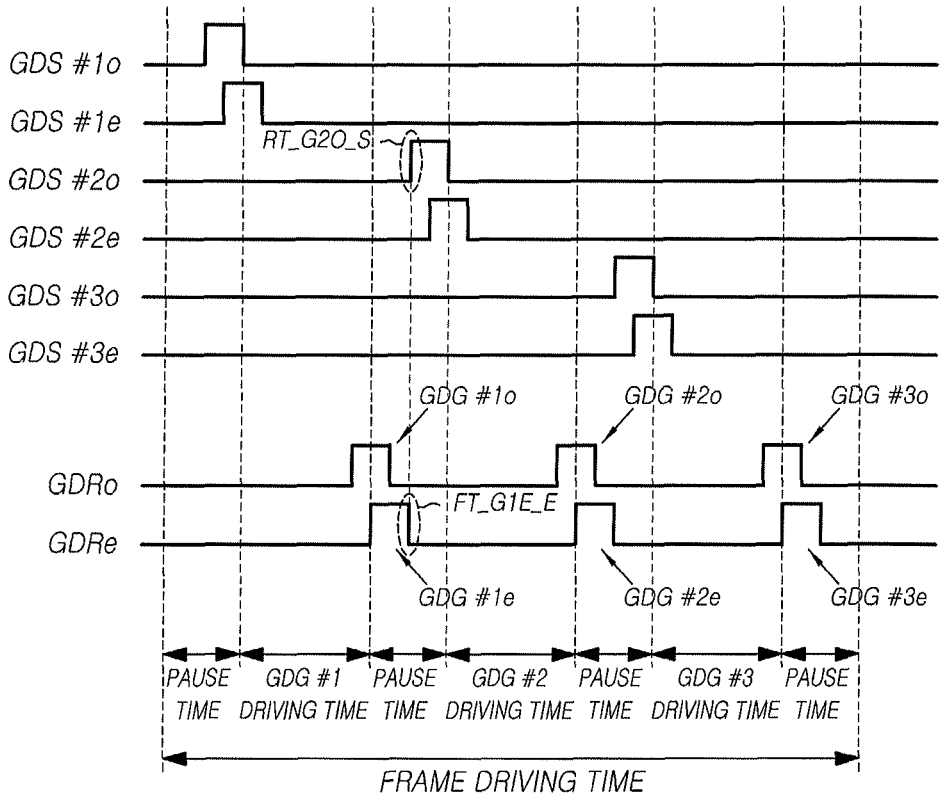
FIG. 17B is a timing diagram of a group driving start signal and a group driving refresh signal, under the signal line structure of FIG. 16B.

FIG. 17B is a timing diagram of six group driving start signals GDS #1*o*, GDS #1*e*, GDS #2*o*, GDS #2*e*, GDS #3*o*, and GDS #3*e*, respectively provided to three gate driving groups GDG #1, GDG #1, and GDG #3, and two group driving refresh signals GDRo and GDRe, under the signal line structure of FIG. 16B.

Referring to FIG. 17B, to report a start of gate driving of each of an odd-numbered gate driving group and an even-numbered gate driving group included in each of the three gate driving groups GDG #1, GDG #2, and GDG #3, the six group driving start signals GDS #o1, GDS #1*e*, GDS #2*o*, GDS #2*e*, GDS #3*o*, and GDS #3*e* are provided to odd-numbered gate driving groups and even-numbered gate driving groups included in the three gate driving groups GDG #1, GDG #2, and GDG #3, respectively.

That is, GDS #1*o* is a control signal to report a start of gate driving of GDG #o1 included in GDG #1, and is provided to GIP #1-1 of GDG #1*o*. GDS #1*e* is a control signal to report a start of gate driving of GDG #1*e* included in GDG #1, and is provided to GIP #1-2 of GDG #1*e*.

That is, GDS #2*o* is a control signal to report a start of gate driving of GDG #2*o* included in GDG #2, and is provided to GIP #2-1 of GDG #2*o*. GDS #2*e* is a control signal to report a start of gate driving of GDG #2*e* included in GDG #2, and is provided to GIP #2-2 of GDG #2*e*.

GDS #3*o* is a control signal to report a start of gate driving of GDG #3*o* included in GDG #3, and is provided to GIP #3-1 of GDG #3*o*. GDS #3*e* is a control signal to report a start of gate driving of GDG #3*e* included in GDG #3, and is provided to GIP #3-2 of GDG #3*e*.

Referring to FIG. 17B, two group driving refresh signals GDRo and GDRe are control signals that report an end of gate driving of each of odd-numbered gate driving groups and even-numbered gate driving groups included in the three gate driving groups GDG #1, GDG #2, and GDG #3, and a signal level (LOW→HIGH or HIGH→LOW) is changed at an end timing of gate driving of each of the odd-numbered gate driving groups and the even-numbered gate driving groups included in the three gate driving groups GDG #1, GDG #2, and GDG #3.

In the example of FIG. 17B, GDRo, which is to report an end of gate driving of each of the odd-numbered gate driving groups GDG #1*o*, GDG #2*o*, and GDG #3*o* respectively included in the three gate driving groups GDG #1, GDG #2, GDG #3 from among the two group driving refresh signals GDRo and GDRe, is maintained in a low level (LOW) before an end timing of gate driving of GDG#1*o*, and is changed to a high level (HIGH) at the end timing, and then, falls to a low level and is maintained before an end timing of gate driving of GDG#2*o*, and is changed to a high level (HIGH) again at the end timing, and then falls to a low level (LOW) and is maintained before an end timing of gate driving of GDG #3*o*, and is changed to a high level (HIGH) again at the end timing, and then falls to a low level (LOW) and is maintained.

In addition, GDRe, which is to report an end of gate driving of each of the even-numbered gate driving groups GDG #1*e*, GDG #2*e*, and GDG #3*e* respectively included in the three gate driving groups GDG #1, GDG #2, GDG #3 from among the two group driving refresh signals GDRo and GDRe, is maintained in a low level (LOW) before an end timing of gate driving of GDG#1*e*, and is changed to a high level (HIGH) at the end timing, and then, falls to a low level and is maintained before an end timing of gate driving of GDG#2*e*, and is changed to a high level (HIGH) again at the end timing, and then falls to a low level (LOW) and is maintained before an end timing of gate driving of GDG #3*e*, and is changed to a high level (HIGH) again at the end timing, and then falls to a low level (LOW) and is maintained.

Although the group driving refresh signals GDRo and GDRe have a signal waveform that rises at the end timing of gate driving of each of the odd-numbered driving groups and even-numbered driving groups respectively included in the three gate driving groups GDG #1, GDG #2, and GDG #3 in the example of FIG. 17B, the group driving refresh signals GDRo and GDRe may have a signal waveform that falls at the end timing of gate driving of each of the odd-numbered driving groups and even-numbered driving groups respectively included in the three gate driving groups GDG #1, GDG #2, and GDG #3.

Referring to FIG. 17B, a rising timing (for example, RT_G2O_S) of a group driving start signal (for example, GDS #2*o*) corresponding to an odd-numbered gate driving group (for example, GDG #2*o*) of an ith gate driving group (for example, GDG #2) may correspond to a falling timing (for example, FT_G1E_E) of a group driving refresh signal GDR corresponding to an even-numbered gate driving group (for example, GDG #1*e*) of an i−1th gate driving group (for example, GDG #1).

Unlike the above example, a falling timing of the group driving start signal (for example, GDS #2*o*) corresponding to the odd-numbered gate driving group (for example, GDG #2*o*) of the ith gate driving group (for example, GDG #2) may correspond to a rising timing of the group driving refresh signal GDR corresponding to the even-numbered gate driving group (for example GDG #1*e*) of the i−1th gate driving group (for example, GDG #1).

Referring to FIG. 17B, a driving time of GDG #1 is a time from a falling timing (or a rising timing) of GDS #o1 to a rising timing (or a falling timing) of GDR corresponding to the GDG #1*e*. A driving time of GDG #2 is a time from a falling timing (or a rising timing) of GDS #2*o* to a rising timing (or a falling timing) of GDR corresponding to the GDG #2*e*. A driving time of GDG #3 is a time from a falling timing (or a rising timing) of GDS #3*o* to a rising timing (or a falling timing) of GDR corresponding to the GDG #3*e*.

When a rising timing (for example, RT_G2O_S) of the group driving start signal (for example, GDS #2*o*) corresponding to the odd-numbered gate driving group (for example, GDG #2*o*) of the ith gate driving group (for example, GDG #2) corresponds to a falling timing (for example, FT_G1E_E) of the group driving refresh signal GDR corresponding to the even-numbered gate driving group (for example GDG #1*e*) of the i−1th gate driving group (for example, GDG #1), as described above, a pause time may exist among driving times of the three gate driving groups GDG #1, GDG #2, and GDG #3, as shown in FIG. 17B.

The pause time may be removed by adjusting a signal waveform to enable a falling timing of the group driving start signal (for example, GDS #2*o*) corresponding to the odd-numbered gate driving group (for example, GDG #2*o*) included in the ith gate driving group (for example, GDG #2) to correspond to a rising timing of the group driving refresh signal GDR corresponding to the even-numbered gate driving group (for example, GDG #1*e*) included in the i−ith gate driving group (for example, GDG #1).

To provide group driving start signals GDS #1, GDS #2, and GDS #3 for partitive gate driving under the deployment in one side, as shown in FIG. 17A, as many group driving start signal lines GDSL #1, GDSL #2, and GDSL #3 as the number of gate driving groups N are required, as shown in FIG. 16A.

In addition, to provide group driving start signals GDS #1*o*, GDS #1*e*, GDS #2*o*, GDS #2*e*, GDS #3*o*, and GDS #3*e* for partitive gate driving under the deployment in both sides, as shown in FIG. 17B, group driving start signal lines GDSL #1*o*, GDSL #1*e*, GDSL #2*o*, GDSL #2*e*, GDSL #3*o*, and GDSL #3*e*, of which the numbers is two times greater than the number of gate driving groups N, are required, as shown in FIG. 16B.

Hereinafter, to reduce the number of group driving start lines, a new signal line structure and a method of generating a group driving start signal will be described.

Figure 18A:
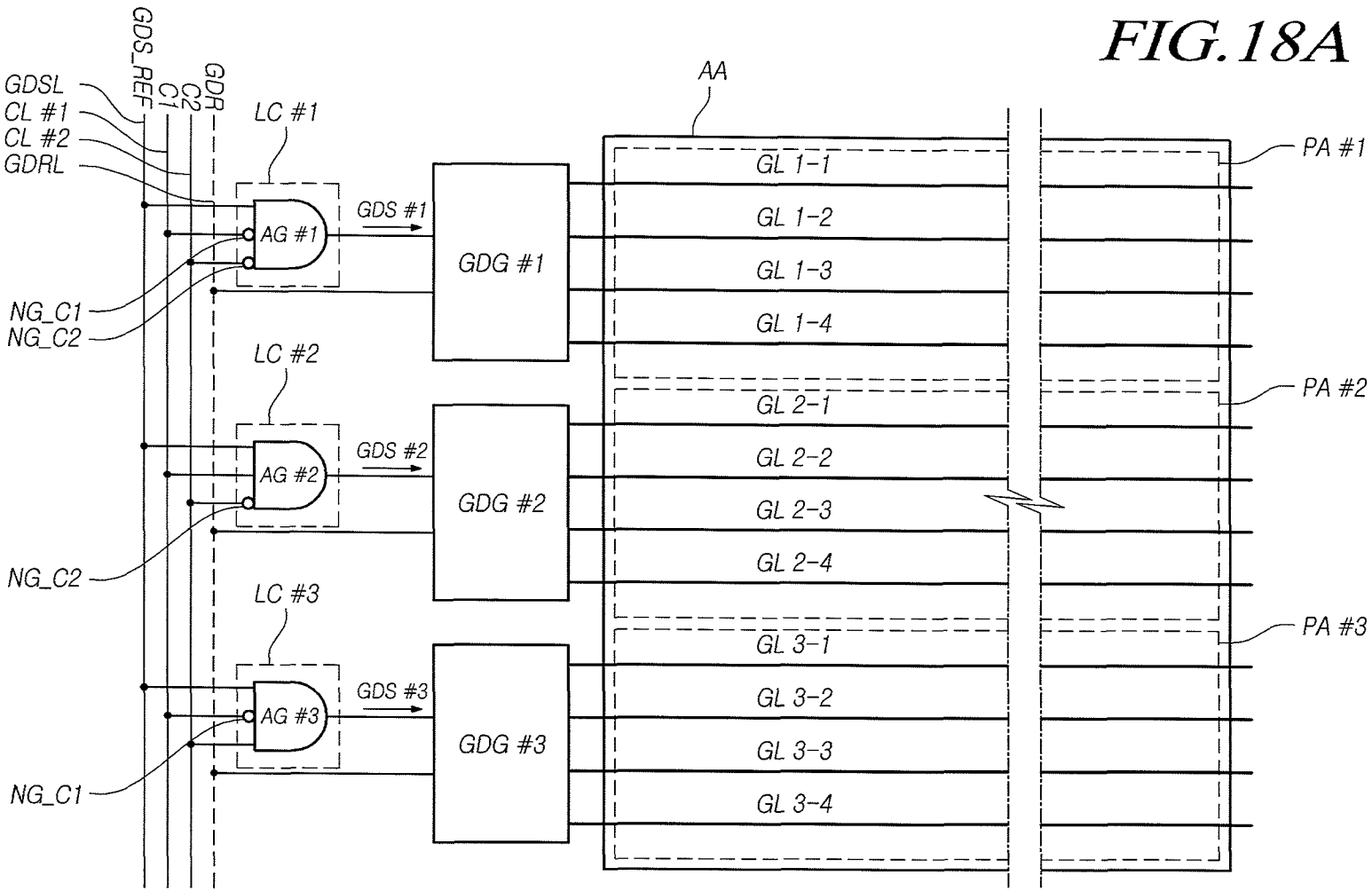
FIG. 18A is an example view of a signal line structure for partitive driving, under the deployment of gate driving integrated circuits of FIG. 13A.
Figure 19A:
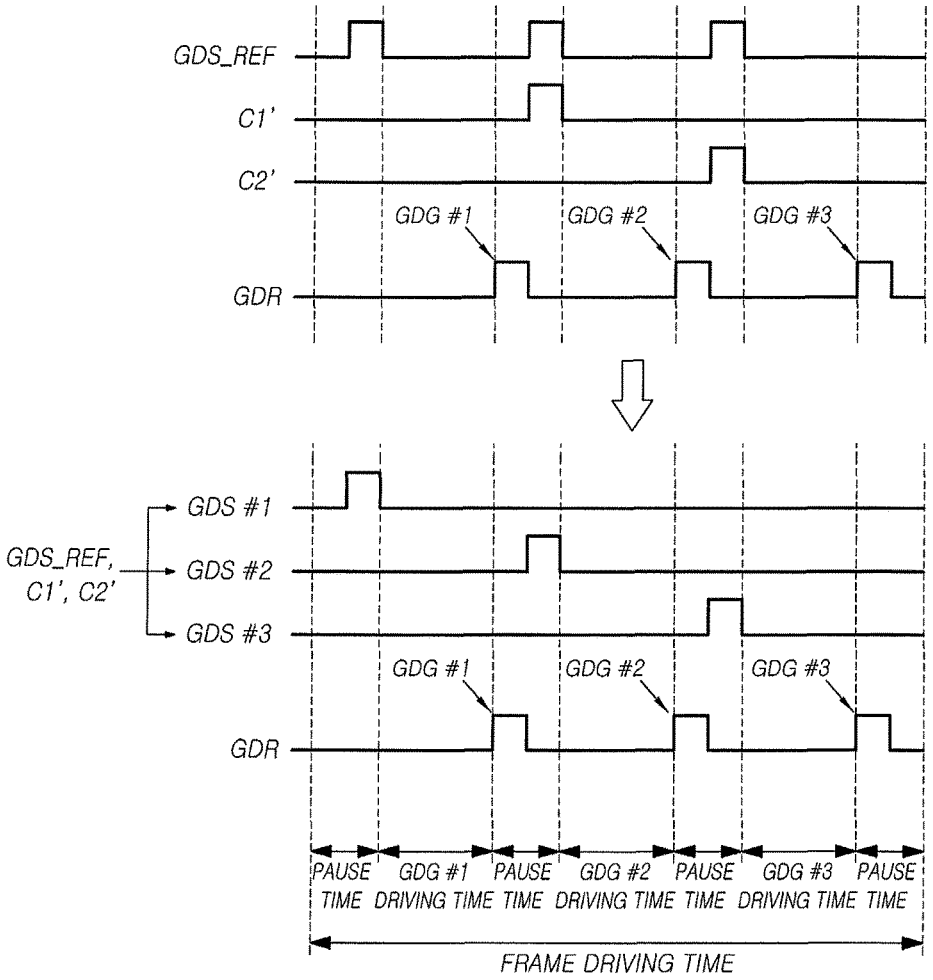
FIG. 19A is a timing diagram of a group driving start signal and a group driving refresh signal for partitive driving, under the signal line structure of FIG. 18A.

FIG. 18A is an example view of a signal line structure for partitive driving, under the one-side deployment of gate driving integrated circuits of FIG. 13A. FIG. 19A is a timing diagram of a group driving start signal and a group driving refresh signal for partitive driving, under the signal line structure of FIG. 18A.

Referring to FIG. 18A, to provide three group driving start signals GDS #1, GDS #2, and GDS #3 in correspondence to three gate driving groups GDG #1, GDG #2, and GDG #3, a single group driving start signal line GDSL and L group control signal lines CL #1, CL #2, . . . , and CL #L (L is a natural number greater than or equal to 2 and L=2 in FIG. 18A) are disposed, and N logic circuits are disposed, N being identical to the number of gate driving groups (for example, N=3) (when N=3, LC #1, LC #2, and LC #3 are disposed).

Each of the N logic circuits (LC #1, LC #2, and LC #3 when N=3) receives a single group driving start reference signal GDS_REF and L group control signals (C1 and C2 when L=2), and outputs a group driving start signal to be provided to a corresponding gate driving group.

For example, LC #1 receives GDS_REF and uses two group driving control signals C1 and C2, and outputs GDS #1. LC #2 receives GDS_REF and uses two group driving control signals C1 and C2, and outputs GDS #2. LC #3 receives GDS_REF and uses two group driving control signals C1 and C2, and outputs GDS #3.

In addition, referring to FIG. 18A, to provide a group driving refresh signal GDR to the three gate driving groups GDG #1, GDG #2, and GDG #3, a single group driving refresh signal line GDRL or N (for example, N=3) group driving refresh signal lines may be disposed.

When the signal line structure of FIG. 18A is used, the number of group driving start signal lines required for providing the three group driving start signals GDS #1, GDS #2, and GDS #3 in correspondence to the three gate driving groups GDG #1, GDG #2, and GDG #3 may be reduced in comparison with the signal line structure of FIG. 16A.

As a matter of course, L group control signal lines are further added. However, as the number of gate driving groups N becomes higher, the effect of a reduction in the number of group driving start signals is higher in comparison with the number of the added group control signal lines. Accordingly, when the signal line structure of FIG. 18A is used, a total number of signal lines may be significantly reduced.

Accordingly, a width (size) of an edge area of the AA where an image is displayed on the display panel 110 may be reduced and thus, a bezel may be reduced.

Referring to FIG. 18A, L corresponding to the group control signals or the number of group control signal lines may be the lowest value from among natural numbers that satisfy $\lceil 2L \geq N$ (the number of gate driving groups$\rfloor$.

For example, as shown in FIG. 18A, when the number of gate driving groups N is 3, L is 2. When the number of gate driving groups N is 4, L is 2. When the number of gate driving groups N is 8, L is 3. When the number of gate driving groups N is 9, L is 4. When the number of gate driving groups N is 32, L is 5.

As described above, L corresponding to the number of group control signals or the number of group control signal lines is a value smaller than the number of gate driving groups N. In addition, as the number of gate driving groups N becomes higher, a difference between N and L becomes higher.

Therefore, when the signal line structure of FIG. 18A is used, L group control signal lines are further added in comparison to the signal line structure of FIG. 16A. However, the number of group driving start signal lines is reduced by N−1−L from N to 1+L and thus, a gain of a reduction in a total number of signal lines is high. As the number of gate driving groups N becomes higher, the gain of the reduction in the total number of signal lines becomes higher.

As described above, by using a smaller (L) number of group control signals and group control signal lines than the number of gate driving groups N, the total number of signal lines may be reduced.

Hereinafter, N corresponding to the number of partial areas or the number of gate driving groups is 3, and thus, a case in which L is 2 will be exemplified. That is, it is assumed that three logic circuits LC #1, LC #2, and LC #3 and two group control signals C1 and C2 are used, and two group control signal lines CL #1 and CL #2 are disposed, so as to provide three group driving start signals GDS #1, GDS #2, and GDS #3 in correspondence to three gate driving groups GDG #1, GDG #2, and GDG #3.

Referring to FIG. 18A and FIG. 19A, each of the two logic circuits LC #1 and LC #2 receives a single group driving start reference signal GDS_REF and two group control signals C1 and C2, and outputs a group driving start signal corresponding to a corresponding gate driving group of the three gate driving groups GDG #1, GDG #2, and GDG #3.

Referring to FIGS. 18A and 19A, LC #1 receives GDS_REF, C1, and C2, and outputs GDS #1 to GDG #1. LC #2 receives GDS_REF, C1, and C2, and outputs GDS #2 to GDG #2. LC #3 receives GDS_REF, C1, and C2, and outputs GDS #3 to GDG #3.

As described above, by equally using the single group driving start reference signal GDS_REF and two group control signals C1 and C2, three group driving start signals GDS #1, GDS #2, and GDS #3 to be provided to three gate driving groups GDG #1, GDG #2, and GDG #3 may be generated.

Referring to FIG. 18A, each of the three logic circuits LC #1, LC #2, and LC #3 includes a single AND Gate (AG), and zero to L NOT Gates (NGs).

Referring to FIG. 18A, LC #1 includes a single AND Gate AG #1 and two NOT Gates NG_C1 and NG_C2, which are connected to two driving control signal input ends C1_input end and C2_input end of AG#1. LC #2 includes a single AND Gate AG #2 and a single NOT Gate NG_C2 which is connected to C2_input end of the two driving control signal input ends C1_input end and C2_input end of AG#2. LC #3 includes a single AND Gate AG #3 and a single NOT Gate NG_C1 which is connected to C1_input end of the two driving control signal input ends C1_input end and C2_input end of AG#3.

Figure 18B:
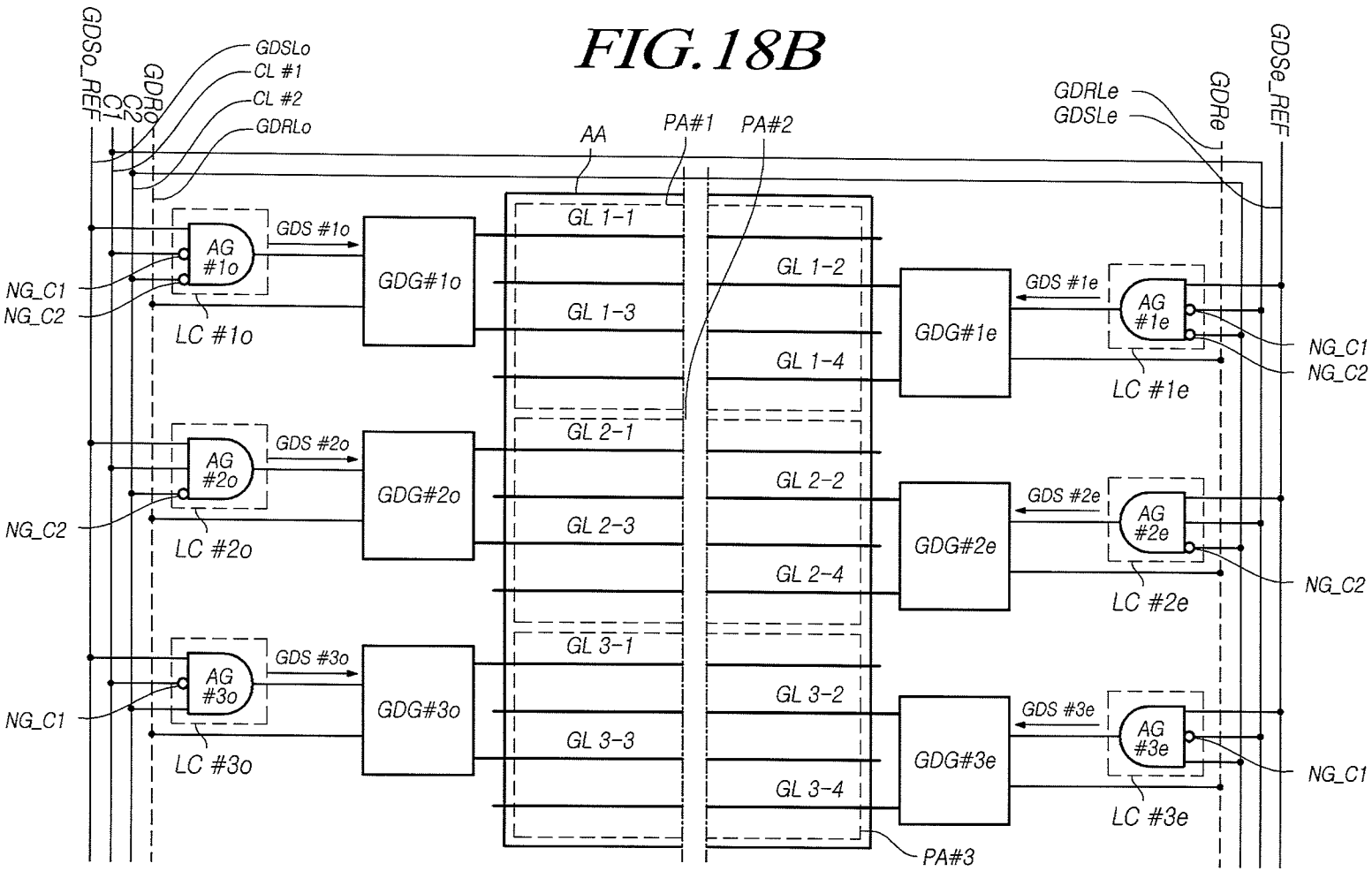
FIG. 18B is an example view of a signal line structure for partitive driving, under the deployment of gate driving integrated circuits of FIG. 13B.
Figure 18C:
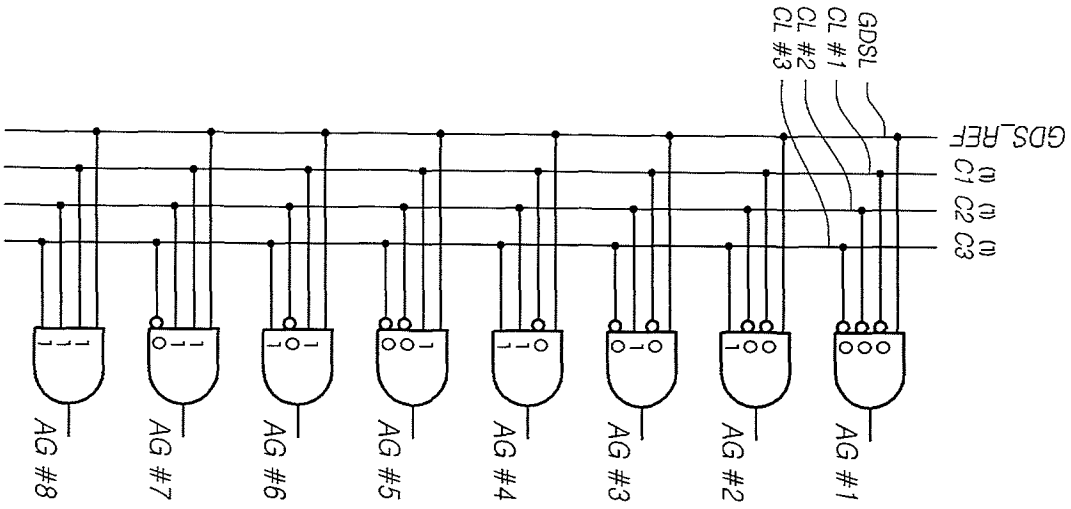
FIG. 18C is an example view illustrating a configuration of a logic circuit when eight gate driving groups and three group control signals are used.

A location and the number of input ends to which a NOT Gate is to be connected from among the input ends of the AND Gate will be readily understood with reference to FIG. 18C.

FIG. 18C is an example view illustrating a configuration of a logic circuit when 8 gate driving groups and 3 group control signals (the number of group control signal lines) are used.

In FIG. 18C, for example, when C1, C2, and C3 are 1, 1, and 1, respectively, C1', C2', and C3,' which are finally input into an AND Gate, are illustrated.

Referring to FIG. 18C, when C1(=1) passes through a NOT Gate, C1' may be 0, and when C1(=1) does not pass through the NOT Gate, C1' may be 1. When C2(=1) passes through a NOT Gate, C2' may be 0, and when C2(=1) does not pass through the NOT Gate, C2' may be 1. When C3(=1) passes through a NOT Gate, C3' may be 0, and when C3(=1) does not pass through the NOT Gate, C3' may be 1.

Referring to FIG. 18C, group control signals C1', C2', and C3' that are finally input into each of the eight AND Gates AG #1, . . . , and AG #8, based on the above described manner, may be 000, 001, 010, 011, 100, 101, 110, and 111. When they are expressed as decimal numbers, they are 0, 1, 2, 3, 4, 5, 6, and 7 and thus, eight gate driving groups or eight group driving start signals are distinguished.

Referring to FIGS. 18A and 19A, an AND Gate AG #1, AG #2, and AG #3 included in each of the three logic circuits LC #1, LC #2, and LC #3 receives a single group driving start reference signal GDS_REF, receives two group control signals C1 and C2 through zero to L NOT Gates, and outputs a group driving start signal corresponding to a corresponding gate driving group.

In other words, each of the three AND Gates AG #1, AG #2, and AG #3 receives the single group driving start reference signal GDS_REF, and receives the two group control signals C1 and C2 directly or via two NOT Gates NG_C1 and NG_C2, or a few of the two group control signals (C1 or C2) via the NOT Gate (NG_C1 or NG_C2) and the remaining (C1 or C2) directly, and outputs the group driving start signal corresponding to the corresponding gate driving group.

For example, referring to FIG. 18A and FIG. 19A, AG #1 receives GDS_REF, receives C1' corresponding to C1 that passes through NG_C1 and C2' corresponding to C2 that passes through NG_C2, and outputs GDS #1. AG #2 receives GDS_REF, directly receives C1 as C1' and receives C2' corresponding to C2 that passes through NG_C2, and outputs GDS #2. AG #3 receives GDS_REF, receives C1' corresponding to C1 that passes through NG_C1 and directly receives C2 as C2', and outputs GDS #3.

GDS #1, GDS #2, and GDS #3 output in this manner may be identical to GDS #1, GDS #2, and GDS #3 in FIG. 17A.

Through the logic circuit configuration as described above, although identical three signals, that is, a single group driving start reference signal GDS_REF provided through a single group driving start signal line GDSL and two group control signals C1 and C2, are used, three different group driving start signals GDS #1, GDS #2, and GDS #3 to be provided to the three gate driving groups GDG #1, GDG #2, and GDG #3 may be generated.

Referring to FIG. 18A, each of the three logic circuits LC #1, LC #2, and LC #3 may be included in one of M gate driving integrated circuits included in a corresponding gate driving group from among the three gate driving groups GDG #1, GDG #2, and GDG #3.

Referring to FIG. 18A, LC #1 may be included in GIP #1-1 included in GDG #1. LC #2 may be included in GIP #2-1 included in GDG #2. LC #3 may be included in GIP #3-1 included in GDG #3.

As described above, the logic circuit configuration may not need to be disposed in the display panel 110 and thus, a width of non-AA of the display panel 110 may be reduced.

Figure 19B:
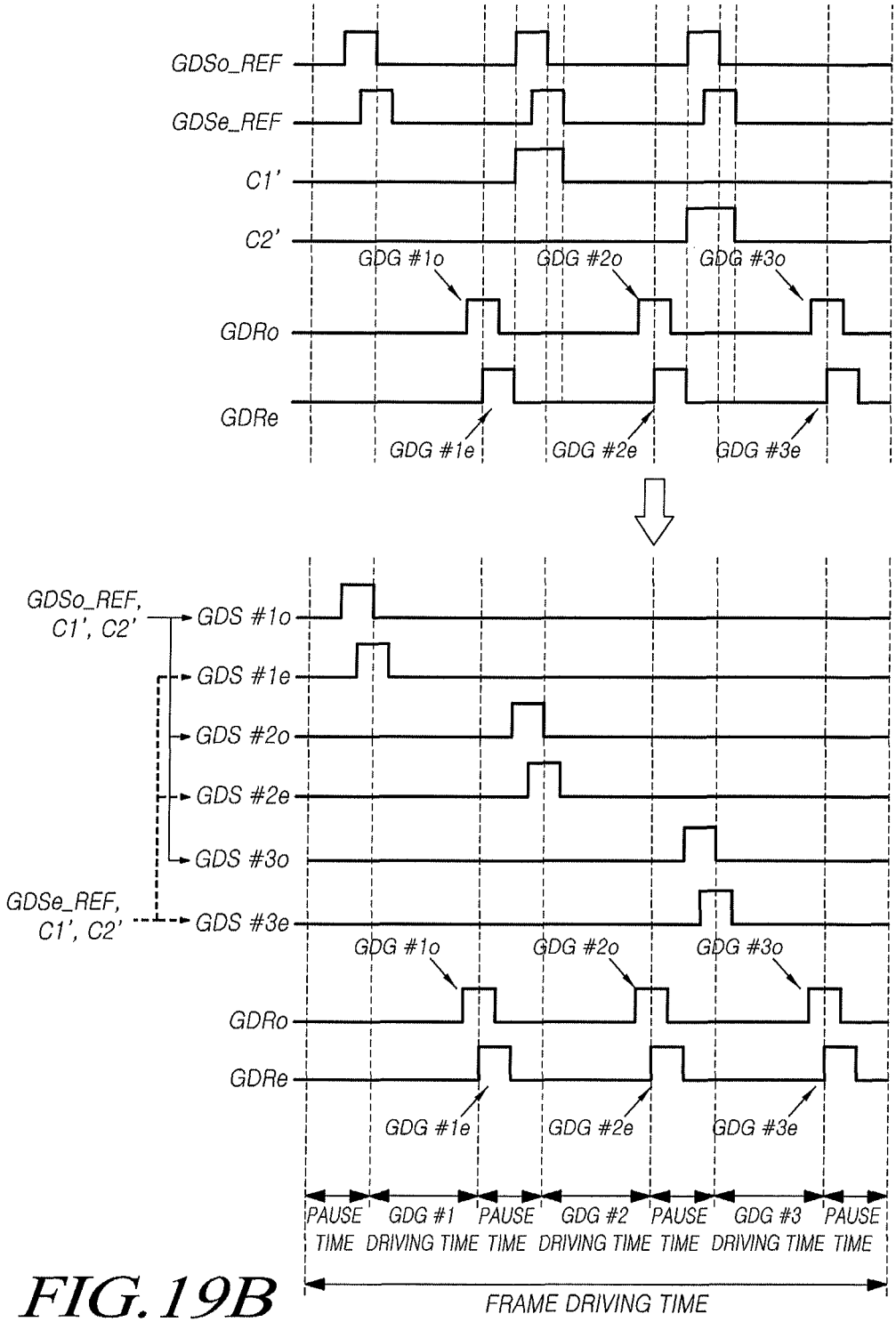
FIG. 19B is a timing diagram of a group driving start signal and a group driving refresh signal for partitive driving, under the signal line structure of FIG. 18B.

FIG. 18B is an example view of a signal line structure for partitive driving, under the both-side deployment of gate driving integrated circuits of FIG. 13B. FIG. 19B is a timing diagram of a group driving start signal and a group driving refresh signal for partitive driving, under the signal line structure of FIG. 18B.

Referring to FIG. 18B and FIG. 19B, each of the three gate driving groups GDG #1, GDG #2, and GDG #3 includes an odd-numbered gate driving group including odd-numbered gate driving integrated circuits and an even-numbered gate driving group including even-numbered gate driving integrated circuits.

Referring to FIG. 18B and FIG. 19B, GDG #1 includes an odd-numbered gate driving group GDG #1*o* including GIP #1-1 and GIP #1-3, and an even-numbered gate driving group GDG #1*e* including GIP #1-2 and GIP #1-4. GDG #2 includes an odd-numbered gate driving group GDG #2*o* including GIP #2-1 and GIP #2-3, and an even-numbered gate driving group GDG #2*e* including GIP #2-2 and GIP #2-4. GDG #3 includes an odd-numbered gate driving group GDG #3*o* including GIP #3-1 and GIP #3-3, and an even-numbered gate driving group GDG #3*e* including GIP #3-2 and GIP #3-4.

Referring to FIG. 18B and FIG. 19B, to provide group driving start signals GDS #1*o*, GDS #2*o*, and GDS #3*o* to odd-numbered gate driving groups GDG #1*o*, GDG #2*o*, and GDG #3*o*, and to provide group driving start signals GDS #1*e*, GDS #2*e*, and GDS #3*e* to even-numbered gate driving groups GDG #1*e*, GDG #2*e*, and GDG #3*e*, with respect to three gate driving groups GDG #1, GDG #2, GDG #3, respectively, two group driving start signal lines GDSLo and GDSLe and two group control signal lines CL #1, CL #2, . . . , and CL #L (L is a natural number greater than or equal to 2 and L=2 in FIG. 18B) are disposed and 2×3 logic circuits LC #1*o*, LC #1*e*, LC #2*o*, LC #2*e*, LC #3*o*, and LC #3*e* may be disposed.

Referring to FIG. 18B, to provide a corresponding group driving refresh signal GDRo to an odd-numbered gate driving group GDG #1*o*, GDG #2*o*, and GDG #3*o* and to provide a corresponding group driving refresh signal GDRe to an even-numbered gate driving group GDG #1*e*, GDG #2*e*, and GDG #3*e*, for each of the three gate driving groups GDG #1, GDG #2, and GDG #3, two group driving refresh signal lines GDRLo and GDRe or 2N group driving refresh signal lines may be disposed.

When the signal line structure of FIG. 18B is used, the number of group driving start signal lines required for providing a total of six group driving start signals GDS #1*o*, GDS #1*e*, GDS #2*o*, GDS #2*e*, GDS #3*o*, and GDS #3*e* in correspondence to three odd-numbered gate driving groups GDG #1*o*, GDG #2*o*, and GDG #3*o* and three even-numbered gate driving groups GDG #1*e*, GDG #2*e*, and GDG #3*e* may be reduced from 6 to 2, in comparison with the signal line structure of FIG. 16B.

As a matter of course, L (for example, L=2) group control signal lines CL #1 and CL #2 are further added. However, as a value of the number of gate driving groups N becomes higher, an effect of a reduction in the number of group driving start signals is higher in comparison with the number of added group control signal lines and thus, a total number of signal lines may be significantly reduced using the signal line structure of FIG. 18B.

Accordingly, a width (size) of an edge area of the AA where an image is displayed on the display panel 110 may be reduced and thus, a bezel may be reduced.

Referring to FIG. 18B, L corresponding to the group control signals or the number of group control signal lines may be the lowest value from among natural numbers that satisfy $\lceil 2L \geq N$ (the number of gate driving groups$\rceil$.

For example, as shown in FIG. 18B, when the number of gate driving groups N is 3, L is 2. When the number of gate driving groups N is 4, L is 2. When the number of gate driving groups N is 8, L is 3. When the number of gate driving groups N is 9, L is 4. When the number of gate driving groups N is 32, L is 5.

As described above, L corresponding to the number of group control signals or the number of group control signal lines is a value smaller than the number of gate driving groups N. In addition, as the number of gate driving groups N becomes higher, a difference between N and L becomes higher.

Therefore, when the signal line structure of FIG. 18B is used, L group control signal lines are further added in comparison to the signal line structure of FIG. 16B. However, the number of group driving start signal lines is reduced by 2N−2−L from 2N to 2+L and thus, a gain of a reduction in a total number of signal lines is high. As the number of gate driving groups N becomes higher, the gain of the reduction in the total number of signal lines becomes higher.

As described above, by using a smaller number of group control signals and group control signal lines than the number of gate driving groups N, the total number of signal lines may be reduced.

Hereinafter, N corresponding to the number of partial areas or the number of gate driving groups is 3, and thus, a case in which L is 2 will be exemplified. That is, it is assumed that six logic circuits LC #1*o*, LC #1*e*, LC #2*o*, LC #2*e*, LC #3*o*, and LC #3*e* and two group control signals C1 and C2 are used and two group control signal lines CL #1 and CL #2 are disposed, so as to provide six group driving start signals GDS #1*o*, GDS #1*e*, GDS #2*o*, GDS #2*e*, GDS #3*o*, and GDS #3*e* to three odd-numbered gate driving groups GDG #1*o*, GDG #2*o*, and GDG #3*o* and three even-numbered gate driving groups GDG #1*e*, GDG #2*e*, and GDG #3*e* included in the three gate driving groups GDG #1, GDG #2, and GDG #3.

Referring to FIG. 18B and FIG. 19B, each of 2×N (for example, N=3) logic circuits LC #1*o*, LC #1*e*, LC #2*o*, LC #2*e*, LC #3*o*, and LC #3*e* receives a corresponding group driving start reference signal from among the two reference signals GDSo_REF and GDSe_REF and two group control signals C1 and C2, and outputs a group driving start signal corresponding to an odd-numbered gate driving group or an even-numbered gate driving group included in a corresponding gate driving group from among the three gate driving groups GDG #1, GDG #2, and GDG #3.

For example, LC #1*o* receives GDSo_REF, C1, and C2, and outputs GDS #1*o* to GDG #1*o* of GDG #1. LC #1*e* receives GDSe_REF, C1, and C2, and outputs GDS #1*e* to GDG #1*e* of GDG #1. LC #2*o* receives GDSo_REF, C1, and C2, and outputs GDS #2*o* to GDG #2*o* of GDG #2. LC #2*e* receives GDSe_REF, C1, and C2, and outputs GDS #2*e* to GDG #2*e* of GDG #2. LC #3*o* receives GDSo_REF, C1, and C2, and outputs GDS #3*o* to GDG #3*o* of GDG #3. LC #3*e* receives GDSe_REF, C1, and C2, and outputs GDS #3*e* to GDG #3*e* of GDG #3.

As described above, by equally using two group driving start reference signals GDSo_REF and GDSe_REF and two group control signals C1 and C2, six group driving start signals GDS #1*o*, GDS #1*e*, GDS #2*o*, GDS #2*e*, GDS #3*o*, and GDS #3*e* to be provided to three odd-numbered gate driving groups GDG #1*o*, GDG #2*o*, and GDG #3*o* and three even-numbered gate driving groups GDG #1*e*, GDG #2*e*, and GDG #3*e* included in three gate driving groups GDG #1, GDG #2, and GDG #3 may be generated.

Referring to FIG. 18B, each of 2×3 logic circuits LC #1*o*, LC #1*e*, LC #2*o*, LC #2*e*, LC #3*o*, and LC #3*e* may include a single AND Gate (AG) and zero to L NOT Gates (NGs).

Referring to FIG. 18B, each of the six AND Gates AG #1*o*, AG #1*e*, AG #2*o*, AG #2*e*, AG #3*o*, and AG #3*e* included in the 2×3 logic circuits LC #1*o*, LC #1*e*, LC #2*o*, LC #2*e*, LC #3*o*, and LC #3*e* receives a corresponding group driving start reference signal from among the two reference signals GDSo_REF and GDSe_REF and receives two group control signals C1 and C2 through zero to L NOT Gates (NGs), and outputs a group driving start signal corresponding to an odd-numbered gate driving group or an even-numbered gate driving group included in a corresponding gate driving group.

For example, referring to FIG. 18B and FIG. 19B, AG #1*o* receives GDSo_REF, receives C1' corresponding to C1 that passes through NG_C1 and C2' corresponding to C2 that passes through NG_C2, and outputs GDS #1*o* to GDG #1*o*. AG #1*e* receives GDSe_REF, directly receives C1 as C1' and receives C1' corresponding to C1 that passes through NG_C1 and C2' corresponding to C2 that passes through NG_C2, and outputs GDS #1*e* to GDG #1*e*. AG #2*o* receives GDSo_REF, directly receives C1 as C1' and receives C2' corresponding to C2 that passes through NG_C2, and outputs GDS #2*o* to GDG #2*o*. AG #2*e* receives GDSe_REF, directly receives C1 as C1' and receives C2' corresponding to C2 that passes through NG_C2, and outputs GDS #2*e* to GDG #2*e*. AG #3*o* receives GDSo_REF, receives C1' corresponding to C1 that passes through NG_C1 and directly receives C2 as C2', and outputs GDS #3*o* to GDG #3*o*. AG #3*o* receives GDSe_REF, receives C1' corresponding to C1 that passes through NG_C1 and directly receives C2 as C2', and outputs GDS #3*e* to GDG #3*e*.

GDS #1*o*, GDS #1*e*, GDS #2*o*, GDS #2*e*, GDS #3*o*, and GDS #3*e* output in this manner may be identical to GDS #1*o*, GDS #1*e*, GDS #2*o*, GDS #2*e*, GDS #3*o*, and GDS #3*e* of FIG. 17B.

Through the above described logic circuit configuration, although identical four signals, that is, two group driving start reference signals GDSo_REF and GDSe_REF and two group control signals C1 and C2, are used, six different group driving start signals GDS #1*o*, GDS #1*e*, GDS #2*o*, GDS #2*e*, GDS #3*o*, and GDS #3*e* to be provided to three gate driving groups GDG #1, GDG #2, and GDG #3 may be generated.

Referring to FIG. 18B, each of the 2×3 logic circuits LC #1*o*, LC #1*e*, LC #2*o*, LC #2*e*, LC #3*o*, and LC #3*e* may be included in one of M/2 gate driving integrated circuits included in an odd-numbered gate driving group or an even-numbered gate driving group included in a corresponding gate driving group from among the three gate driving groups GDG #1, GDG #2, and GDG #3.

Here, M denotes the number of gate driving integrated circuits included in a single gate driving group. Therefore, the number of gate driving integrated circuits included in a single odd-numbered gate driving group or a single even-numbered gate driving group may be M/2.

As described above, the logic circuit configuration may not need to be disposed in the display panel 110 and thus, a width of non-AA of the display panel 110 may be reduced.

In FIG. 19A, the upper timing diagram corresponds to a timing diagram of a single group driving start reference signal GDS_REF, two group control signals C1' and C2' finally input into each AND Gate, and a single group driving refresh signal GDR, and the lower timing diagram corresponds to a timing diagram of three group driving start signals GDS #1, GDS #2, and GDS #3, output from three logic circuits LC #1, LC #2, and LC #3 to three gate driving groups GDG #1, GDG #2, and GDG #3, and a single group driving refresh signal GDR.

The lower timing diagram of FIG. 19A is identical to the timing diagram of FIG. 17A.

Referring to FIG. 19A, three AND Gates AG #1, AG #2, and AG #3 included in three logic circuits LC #1, LC #2, and LC #3 generate three group driving start signals GDS #1, GDS #2, and GDS #3 using a single group driving start reference signal GDS_REF and two group control signals C1' and C2' which are finally input into each AND Gate, and output the same to three gate driving groups GDG #1, GDG #2, and GDG #3.

Referring to the lower timing diagram of FIG. 19A, a rising timing of a group driving start signal (for example, GDS #2) output to an ith gate driving group (for example, GDG #2) from an ith logic circuit (for example, LC #2) corresponds to a falling timing of a group driving refresh signal GDR corresponding to an i−1th gate driving group (for example, GDG #1).

Unlike the lower timing diagram of FIG. 19A, a falling timing of the group driving start signal (for example, GDS #2) output to the ith gate driving group (for example, GDG #2) from the ith logic circuit (for example, LC #2) may correspond to a rising timing of the group driving refresh signal GDR corresponding to the i−1th gate driving group (for example, GDG #1).

As described above, by equally using the single group driving start reference signal GDS_REF and two group control signals C1 and C2, three group driving start signals GDS #1, GDS #2, and GDS #3 to be provided to three gate driving groups GDG #1, GDG #2, and GDG #3 may be generated. In addition, by adjusting a timing to include a pause time as shown in the lower timing diagram of FIG. 19A, partitive driving of partial areas may be efficiently provided by minimizing a driving load.

In FIG. 19B, the upper timing diagram corresponds to a timing diagram of two group driving start reference signals GDSo_REF and GDSe_REF, two group control signals C1' and C2' finally input into each AND Gate, and two group driving refresh signals GDRo and GDRe, and the lower timing diagram corresponds to a timing diagram of six group driving start signals GDS #1*o*, GDS #1*e*, GDS #2*o*, GDS #2*e*, GDS #3*o*, and GDS #3*e* output from three logic circuits LC #1, LC #2, and LC #3 to three gate driving groups GDG #1, GDG #2, and GDG #3, each including an odd-numbered gate driving group and an even-numbered gate driving group, and two group driving refresh signals GDRo and GDRe.

The lower timing diagram of FIG. 19B is identical to the timing diagram of FIG. 17B.

Referring to FIG. 19B, a rising timing of a group driving start signal (for example, GDSo #2) corresponding to an odd-numbered gate driving group (for example, GDGo #2) of an ith gate driving group (for example, GDG #2) may correspond to a falling timing of a group driving refresh signal (GDRe) corresponding to an even-numbered gate driving group (for example, GDGe #1) of an i−1th gate driving group (for example, GDG #1).

Unlike FIG. 19B, a falling timing of the group driving start signal (for example, GDSo #2) corresponding to the odd-numbered gate driving group (for example, GDGo #2) included in the ith gate driving group (for example, GDG #2) may correspond to a rising timing of the group driving refresh signal GDRe corresponding to the even-numbered gate driving group (for example, GDGe #1) included in the i−1th gate driving group (for example, GDG #1).

As described above, by equally using two group driving start reference signals GDSo_REF and GDSe_REF and two group control signals C1 and C2, six group driving start signals GDS #1*o*, GDS #1*e*, GDS #2*o*, GDS #2*e*, GDS #3*o*, and GDS #3*e* to be provided to three odd-numbered gate driving groups GDG #1*o*, GDG #2*o*, and GDG #3*o* and three even-numbered gate driving groups GDG #1*e*, GDG #2*e*, and GDG #3*e* included in three gate driving groups GDG #1, GDG #2, and GDG #3 may be generated. In addition, by adjusting a timing to include a pause time as shown in the lower timing diagram of FIG. 19B, partitive driving of partial areas may be efficiently provided by minimizing a driving load.

Hereinafter, a partial driving method will be described by utilizing the partitive driving method described with reference to FIGS. 18A through 19B.

Figure 20:
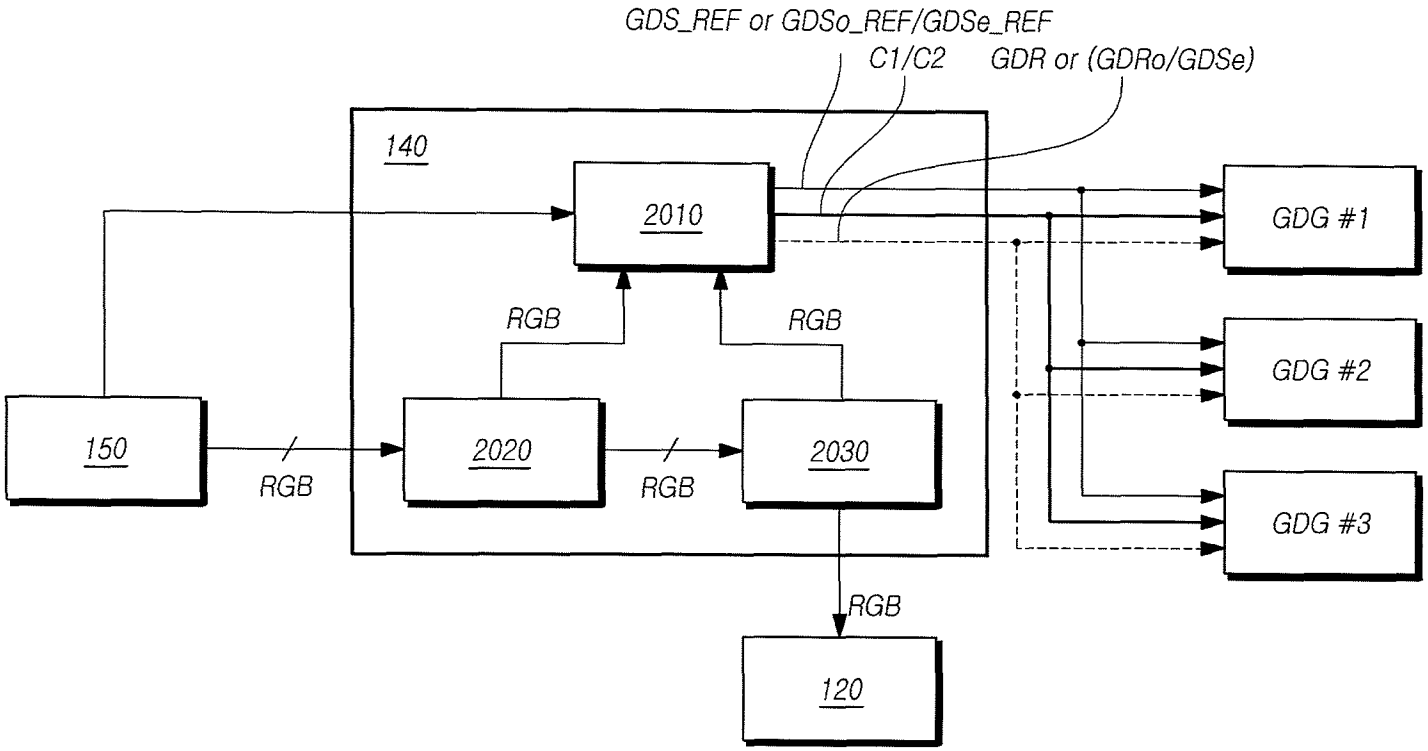
FIG. 20 is a block diagram of a timing controller for partial gate driving of a display device according to the present exemplary embodiments.

FIG. 20 is a block diagram of the timing controller 140 for partial gate driving of the display device 100 according to the present embodiments.

Referring to FIG. 20, the timing controller 140 includes a controller 2010, a first frame buffer 2020, a second frame buffer 2030, and the like.

The first frame buffer 2020 stores image data of a current frame, which is input from the system interface 150.

When new image data (RGB) of a current frame is input into the first frame buffer 2020, the second frame buffer 2030 receives image data of a previous frame that is stored in the first frame buffer 2020, and stores the same.

The controller 2010 compares the image data of the previous frame stored in the second frame buffer 2030 and the image data of the current frame stored in the first frame buffer 2020, selects a gate driving group including gate driving integrated circuits to be actually operated from among all of the gate driving groups, and executes a control so as to provide a control signal GDS and GDR for partial gate driving to a first gate driving integrated circuit and a last gate driving integrated circuit of gate driving integrated circuits included in the selected gate driving group.

The controller 2010 outputs a single group driving start reference signal GDS_REF or two group driving start reference signals GDSo_REF and GDSe_REF, outputs two group control signals C1 and C2, and outputs a single group driving refresh signal GDR or two group driving refresh signals GDRo and GDRe, so as to provide a corresponding group driving start signal to a corresponding gate driving integrated circuit in correspondence to a starting time assigned to each gate driving group selected for the partial gate driving.

In this instance, a frame driving time is identical among all frames irrespective of the number of selected gate driving groups, and a driving time assigned to each gate driving group that is selected is identical to a pause time assigned to each gate driving group that is not selected.

Alternatively, the controller 2010 of the timing controller 140 assigns a frame driving time to only a selected gate driving group, and controls a timing so that a corresponding group driving start signal is provided in correspondence to a starting time of a time assigned to each selected gate driving group.

Figure 21:
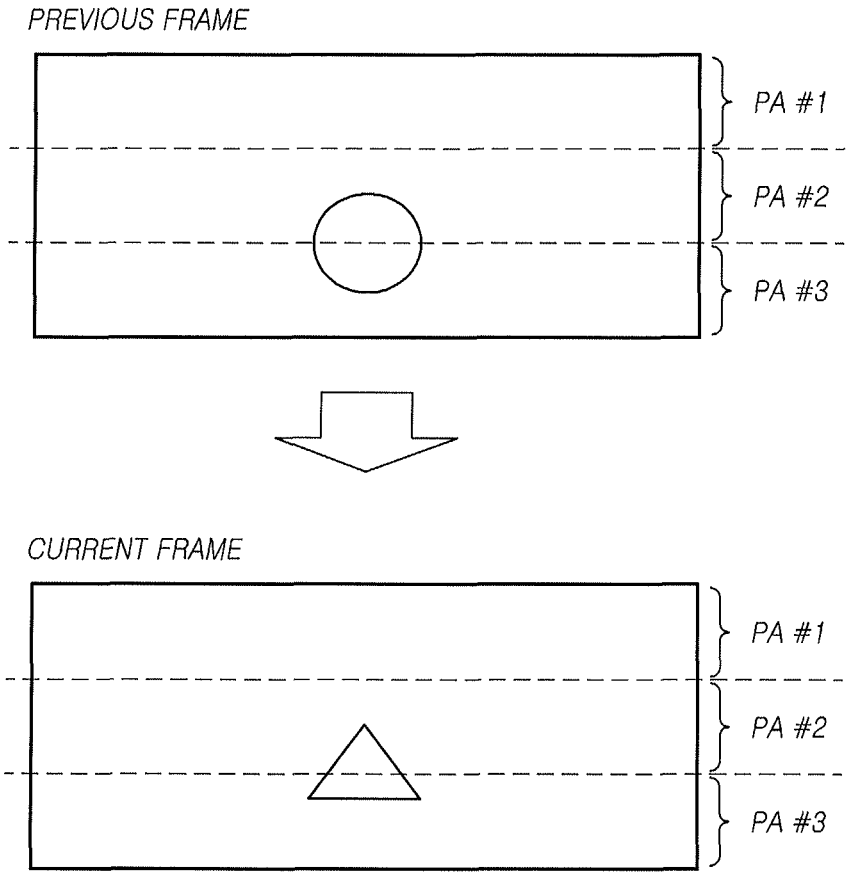
FIG. 21 is an example view illustrating a change in image data of each partial area, between a previous frame and a current frame, in a display device according to the present embodiments.

FIG. 21 is an example view illustrating a change in image data of each partial area, between a previous frame and a current frame, in the display device 100 according to the present embodiments.

Referring to FIG. 21, the current frame has a change in an image in only PA #2 and PA #3 from among three partial areas PA #1, PA #2, and PA #3 of AA, in comparison with a previous frame.

The timing controller 140 recognizes that a change in an image exists in PA #2 and PA #3 and an image is not changed in PA#1, and selects gate driving groups GDG #2 and GDG #3, including gate driving integrated circuits that may output a scan signal to a gate line formed in the partial areas PA #2 and PA #3 including the change in the image.

Here, selecting gate driving groups GDG #2 and GDG #3 to be actually operated (driven) from among all of the gate driving groups GDG #1, GDG #2, and GDG #3 for partial gate driving, is identical to selecting gate driving integrated circuits that actually output a scan signal from among all of the gate driving integrated circuits GIP #1, . . . , and GIP #12.

Subsequently, the timing controller 140 outputs a single or two group driving start reference signals, and a group driving refresh signal, to a first gate driving integrated circuit and a last gate driving integrated circuit included in a selected gate driving group, for partial gate driving. In this instance, it is assumed that a logic circuit is included in a corresponding gate driving integrated circuit.

Figure 22A:
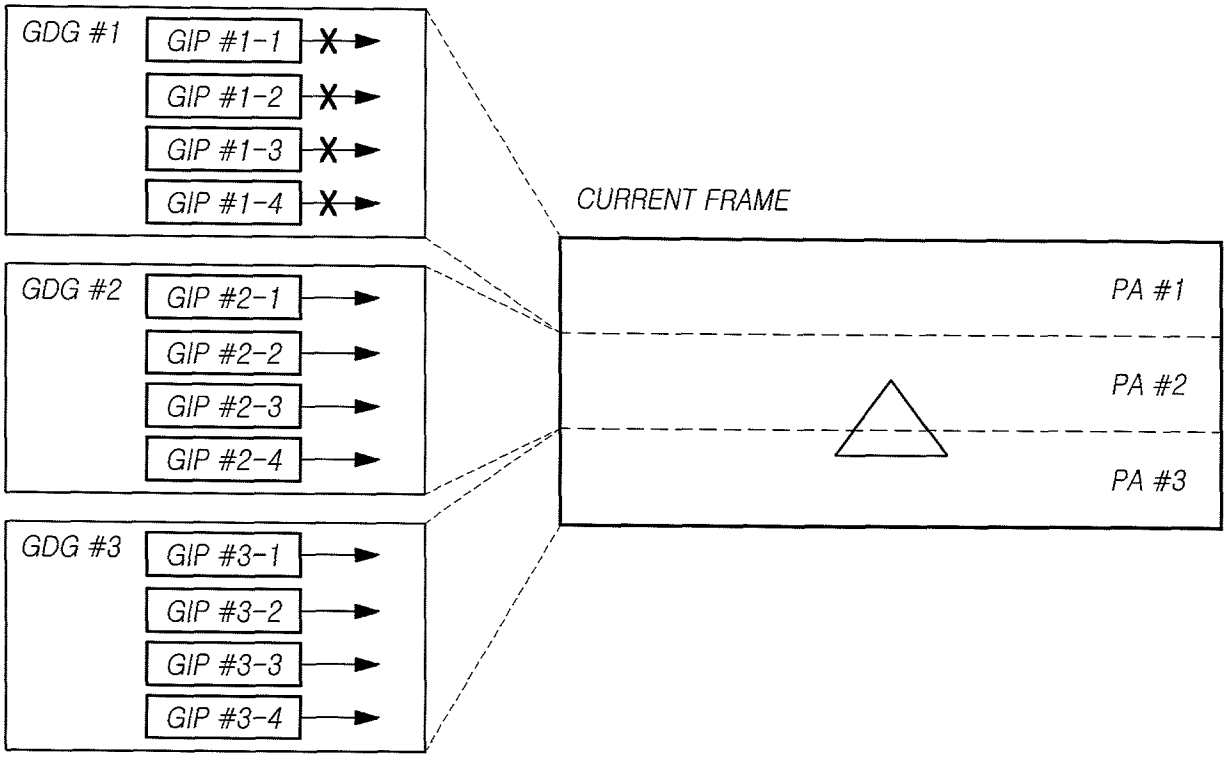
FIGS. 22A and 22B are views illustrating a state of outputting a scan signal for partial gate driving, under the change of the image data of FIG. 21, in a display device according to the present embodiments.
Figure 22B:
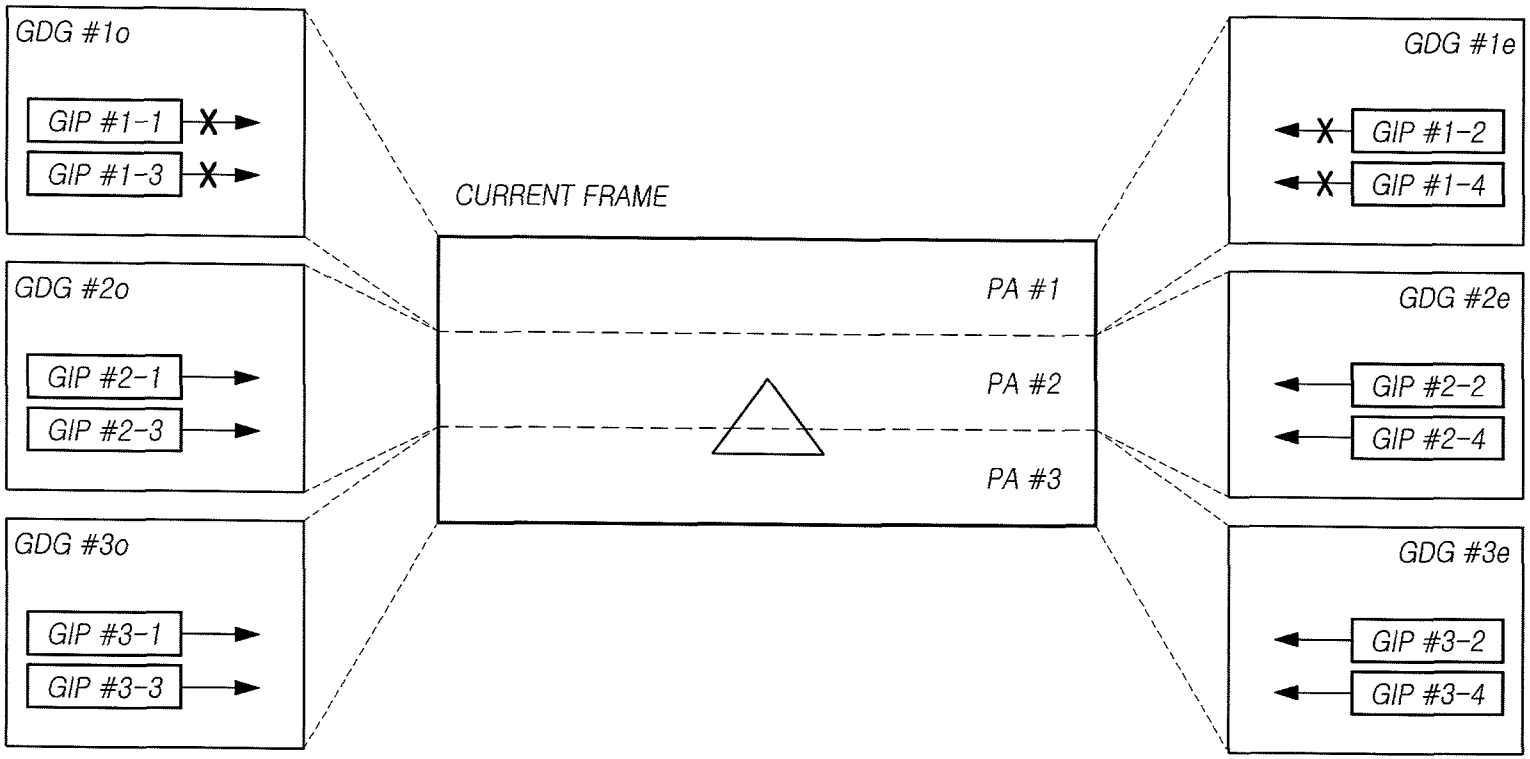

FIGS. 22A and 22B are views illustrating output of a scan signal for partitive gate driving, under the change of the image data of FIG. 21, in the display device 100 according to the present embodiments.

Referring to FIGS. 22A and 22B, through the timing controller 140, scan signals are sequentially output from only gate driving integrated circuits included in gate driving groups GDG #2 and GDG #3 selected from among all of the gate driving groups GDG #1, GDG #2, and GDG #3, and a scan signal is not output from gate driving integrated circuits included in the remaining gate driving group GDG #1.

Accordingly, driving is executed only in the two partial areas PA #2 and PA #3 that are determined to have a change in an image, in the AA formed of three partial areas PA #1, PA #2, and PA #3.

Figure 23A:
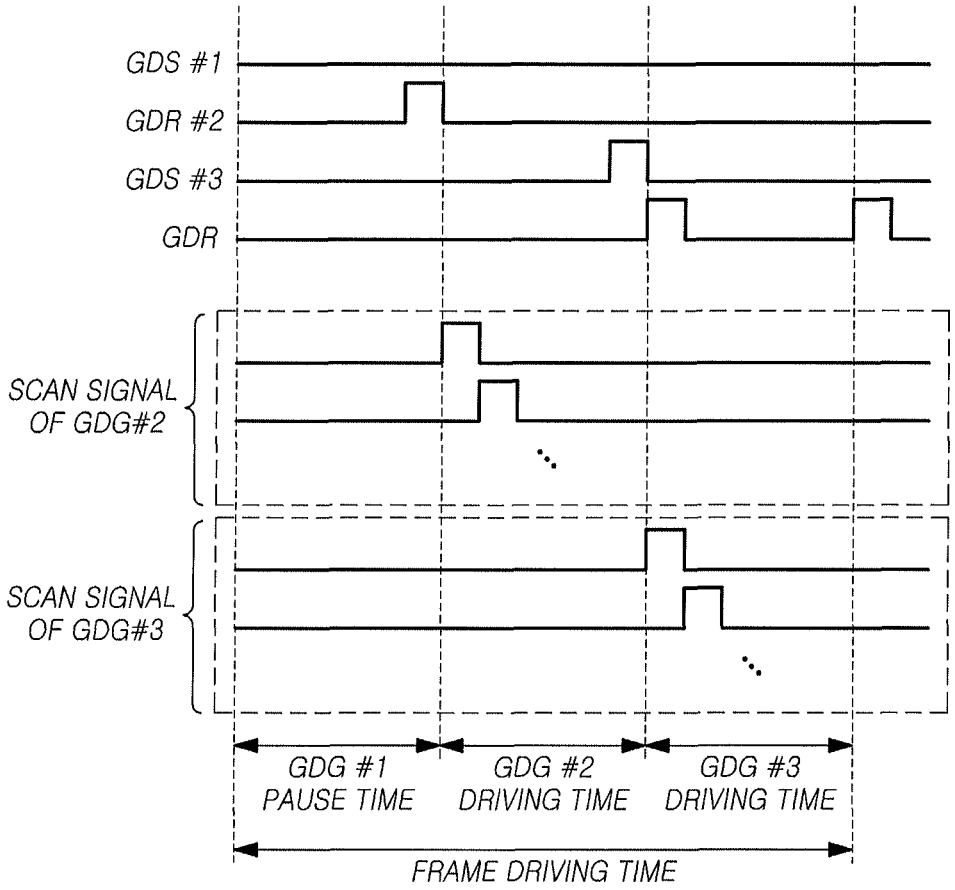
FIG. 23A is a view illustrating a group driving start signal, a group driving refresh signal, and a scan signal, for partial gate driving, based on a scheme of generating three group driving start signals using a single group driving start reference signal and two group control signals, as illustrated in FIG. 19A.

FIG. 23A is a view illustrating a group driving start signal, a group driving refresh signal GDR, and a scan signal, for partial gate driving, based on a scheme of generating three group driving start signals GDS #1, GDS #2, and GDS #3 using a single group driving start reference signal GDS_REF and two group control signals C1 and C2, as illustrated in FIG. 19A.

Referring to FIG. 23A, through the timing controller 140, scan signals are sequentially output from only gate driving integrated circuits included in gate driving groups GDG #2 and GDG #3 selected from among all of the gate driving groups GDG #1, GDG #2, and GDG #3, and a scan signal is not output from gate driving integrated circuits included in the remaining gate driving group GDG #1.

Accordingly, driving is executed only in the two partial areas PA #2 and PA #3 that are determined to have a change in an image, in the AA formed of three partial areas PA #1, PA #2, and PA #3.

Figure 23B:
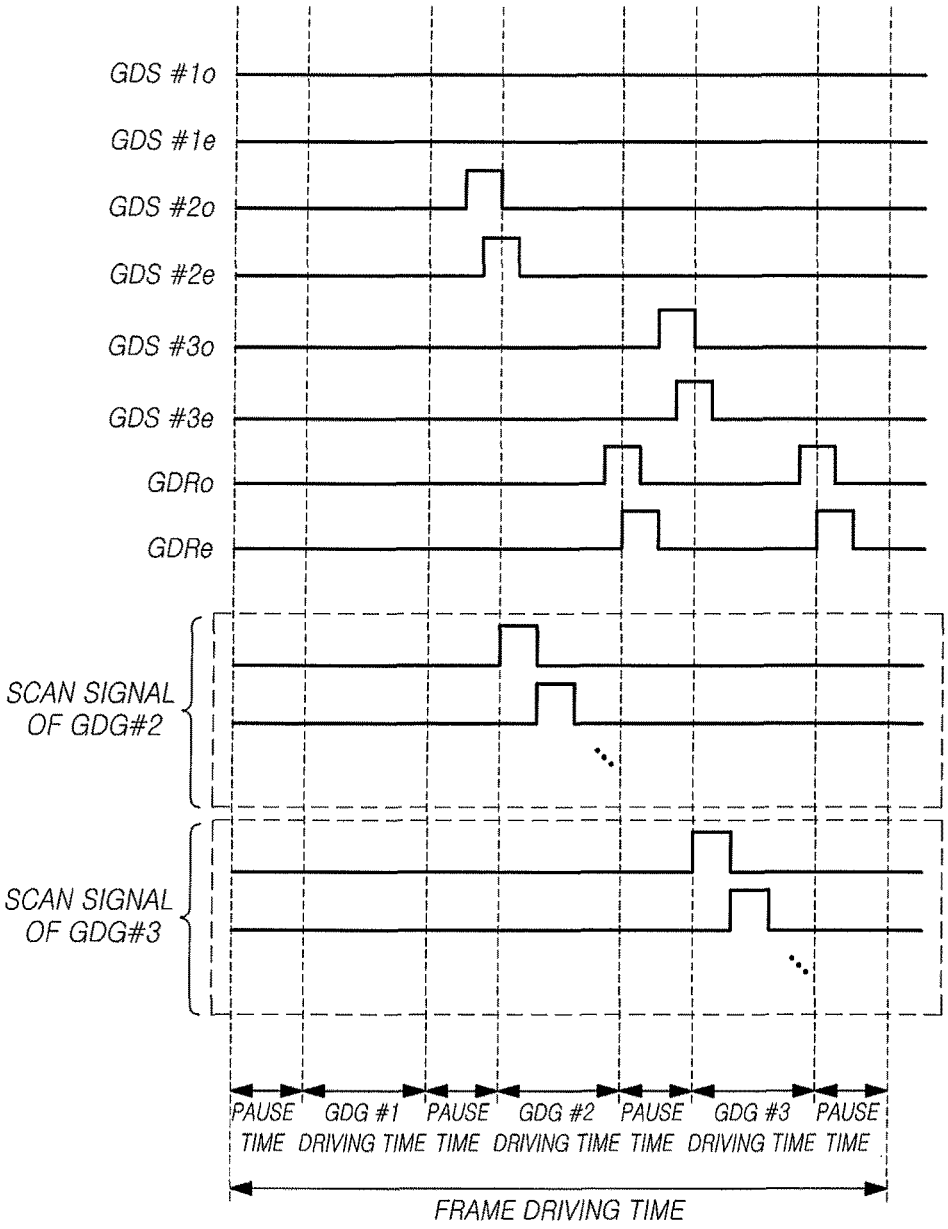
FIG. 23B is a view illustrating a group driving start signal, a group driving refresh signal, and a scan signal, for partial gate driving, based on a scheme of generating six group driving start signals using two group driving start reference signals and two group control signals, as illustrated in FIG. 19B.

FIG. 23B is a view illustrating a group driving start signal, a group driving refresh signal GDRo and GDRe, and a scan signal, for partial gate driving, based on a scheme of generating six group driving start signals GDS #1*o*, GDS #1*e*, GDS #2*o*, GDS #2*e*, GDS #3*o*, and GDS #3*e* using two group driving start reference signals GDSo_REF and GDSe_REF and two group control signals C1 and C2, as illustrated in FIG. 19B.

Referring to FIG. 23B, through the timing controller 140, scan signals are sequentially output from only gate driving integrated circuits included in gate driving groups GDG #2 and GDG #3 selected from among all of the gate driving groups GDG #1, GDG #2, and GDG #3, and a scan signal is not output from gate driving integrated circuits included in the remaining gate driving group GDG #1.

Accordingly, driving is executed only in the two partial areas PA #2 and PA #3 that are determined to have a change in an image, in the AA formed of three partial areas PA #1, PA #2, and PA #3.

Figure 24A:
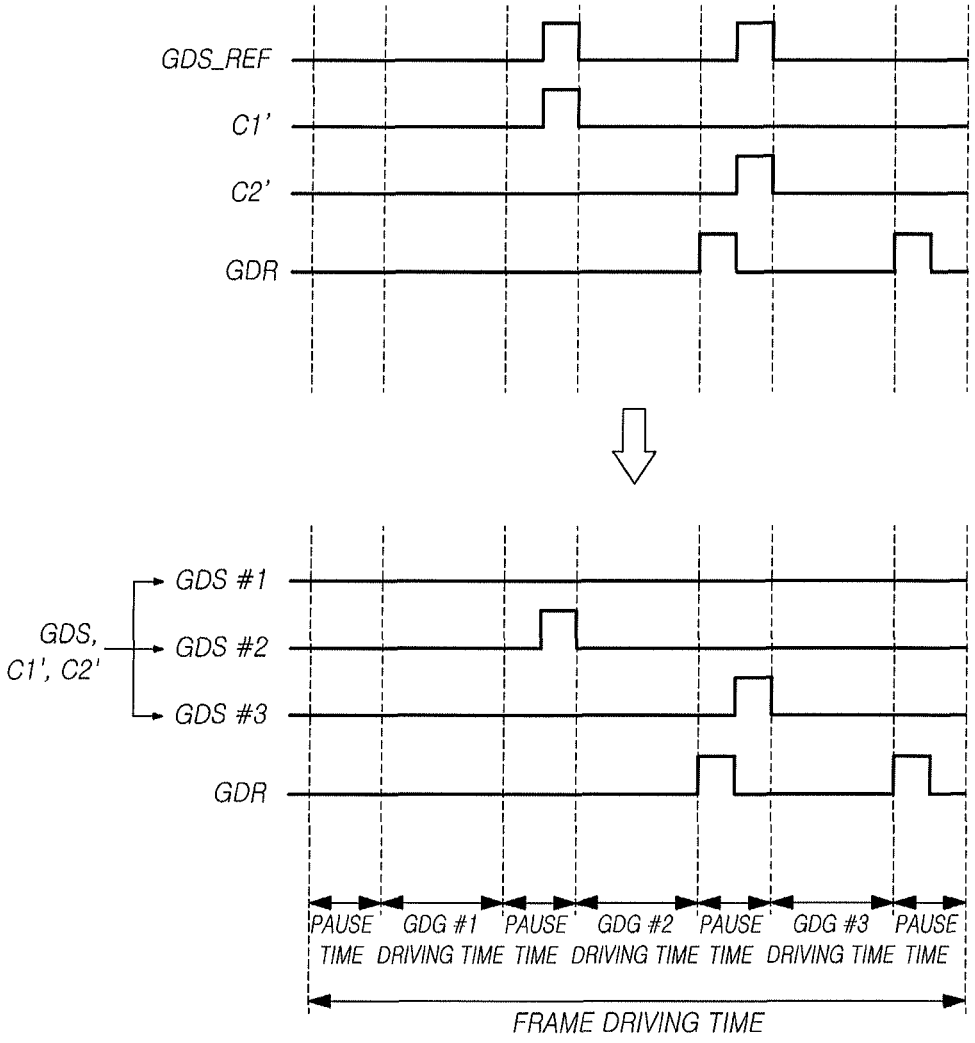
FIG. 24A is a view illustrating three group driving start signals (GDS #1, GDS #2, and GDS #3) generated using a single group driving start reference signal (GDS_REF) and two group control signals (C1 and C2), based on a scheme described with reference to FIG. 19A, so as to partially drive only two partial areas (PA #2 and PA #3)

FIG. 24A is a view illustrating three group driving start signals GDS #1, GDS #2, and GDS #3 generated using a single group driving start reference signal GDS_REF and two group control signals C1 and C2, based on a scheme described with reference to FIG. 19A, so as to partially drive two partial areas PA #2 and PA #3.

Referring to FIG. 24A, only GDS #2 and GDS #3 have a high level section in a corresponding driving timing, and GDS #1 does not include a high level section.

In addition, referring to FIG. 24A, in GDR, a high level section does not exist in a driving timing corresponding to GDG #1, and a high level section exists only in driving timings corresponding to GDG #2 and GDG #3.

Figure 24B:
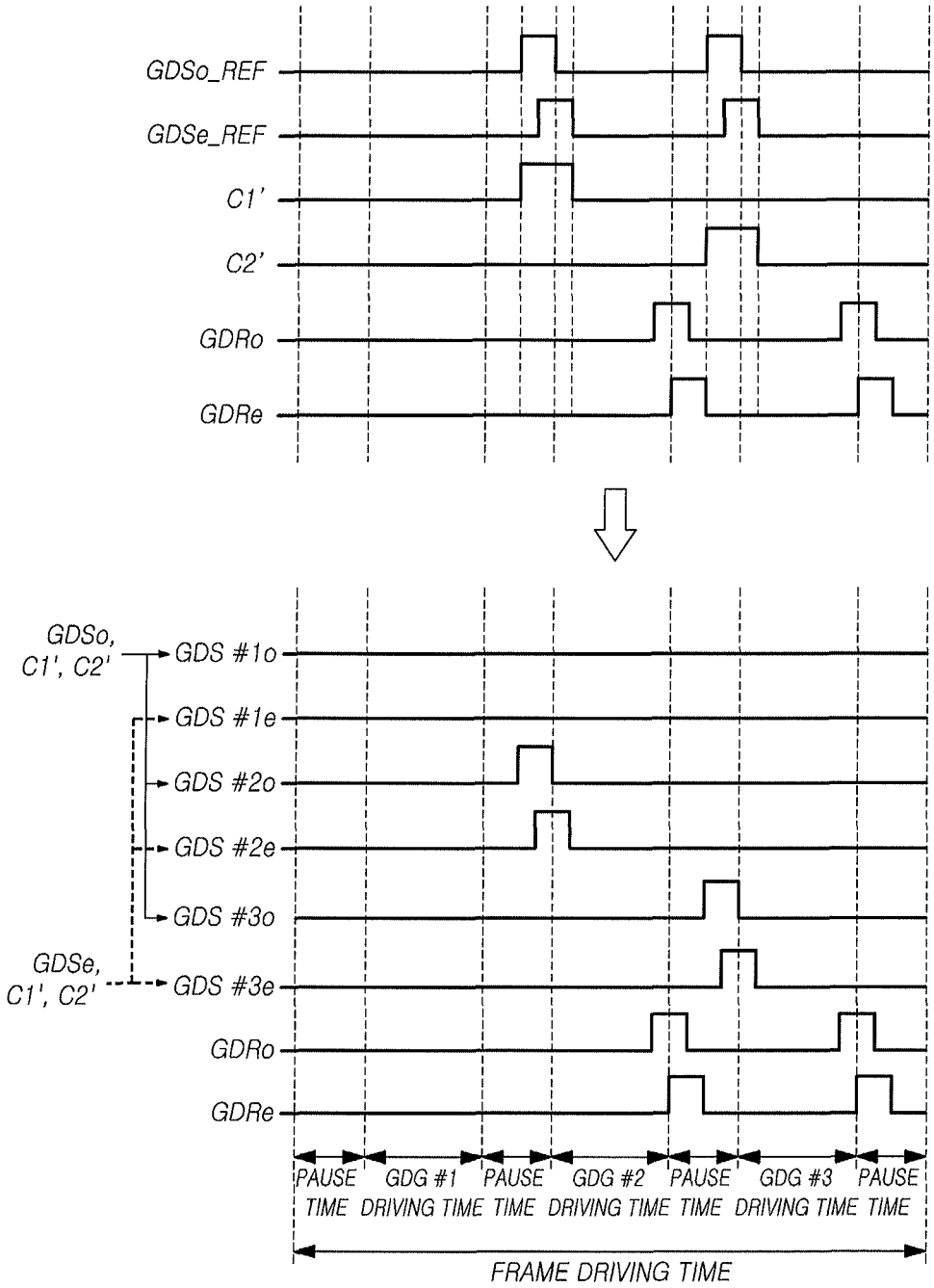
FIG. 24B is a view illustrating six group driving start signals (GDS #1*o*, GDS #1*e*, GDS #2*o*, GDS #2*e*, GDS #3*o*, GDS #3*e*) generated using two group driving start reference signals (GDSo_REF and GDSe_REF) and two group control signals (C1 and C2), based on a scheme described with reference to FIG. 19B, so as to partially drive only two partial areas (PA #2 and PA #3).

FIG. 24B is a view illustrating six group driving start signals GDS #1*o*, GDS #1*e*, GDS #2*o*, GDS #2*e*, GDS #3*o*, and GDS #3*e* generated using two group driving start reference signals GDSo_REF and GDSe_REF and two group control signals C1 and C2, based on a scheme described with reference to FIG. 19B, so as to partially drive two partial areas PA #2 and PA #3.

Referring to FIG. 24B, only GDS #2*o*, GDS #2*e*, GDS #3*o*, and GDS #3*e* have a high level section in a corresponding driving timing, and GDS #1*o* and GDS #1*e* do not include a high level section.

In addition, referring to FIG. 24B, in GDRo, a high level section does not exist in a driving timing corresponding to GDG #1*o*, and a high level section exists only in driving timings corresponding to GDG #2*o* and GDG #3*o*. In GDRe, a high level section does not exist in a driving timing corresponding to GDG #1*e*, and a high level section exists only in driving timings corresponding to GDG #2*e* and GDG #3*e*.

According to the present embodiments as described above, there may be provided an effective partitive driving method and the display device 100 that provides the same.

According to the present embodiments, there may be provided the display device 100 having a signal line structure for effective partitive driving.

According to the present embodiments, there may be provided the display device 100 that may minimize the number of signal lines for partitive driving.

According to the present embodiments, there may be provided a partial gate driving method and the display device 100 that may provide the same.

According to the present embodiments, there may be provided a gate driving method that may reduce a driving time or power consumption, and the display device 100 that may provide the same.

While the technical spirit of the present invention has been exemplarily described with reference to the accompanying drawings, it will be understood by a person skilled in the art that the present invention may be varied and modified in various forms without departing from the scope of the present invention. Accordingly, the embodiments disclosed in the present invention are merely to not limit but describe the technical spirit of the present invention. Further, the scope of the technical spirit of the present invention is limited by the embodiments. The scope of the present invention shall be construed on the basis of the accompanying claims in such a manner that all of the technical ideas included within the scope equivalent to the claims belong to the present invention.

DESCRIPTION OF REFERENCE NUMERALS

100: display device
120: data driving unit
130: gate driving unit
140: timing controller

What is claimed is:

1. A display device, comprising:

a display panel having a plurality of data lines and a plurality of gate lines;

a data driving unit that drives the plurality of data lines;

a gate driving unit that drives the plurality of gate lines, and includes a plurality of gate driving integrated circuits; and a timing controller that controls the data driving unit and the gate driving unit, wherein the plurality of gate driving integrated circuits are separated based on M (a natural number greater than or equal to 2) entities, so as to be classified into N (a natural number greater than or equal to 2) gate driving groups, and the N gate driving groups correspond to N partial areas of the display panel, and each of the N gate driving groups separately operate based on a corresponding single group driving start signal and a corresponding single group driving refresh signal, wherein:

each of the corresponding single group driving start signal is a respective single output from a corresponding logic circuit having a single AND gate which is separate from each of the N gate driving groups and the single AND gate having both a non-inverting input and L NOT gates inputs, each of the corresponding single group driving start signal outputs to only the corresponding N gate driving group is formed by logically combining the following signals received by the single AND gate: a single group driving start reference signal at the non-inverting input and directly receiving a few or all of L group control signals at the L NOT gates inputs; and a group driving refresh signal line is disposed to provide a corresponding single group driving refresh signal to each of the N gate driving groups.

2. The display device of claim 1, wherein L is the lowest value among natural numbers satisfying $2^L \geq N$.

3. The display device of claim 1, wherein a rising timing of the corresponding single group driving start signal corresponding to an $i^{th}$ gate driving group, corresponds to a falling timing of a group driving refresh signal corresponding to an $i-1^{th}$ gate driving group; or a falling timing of the group driving start signal corresponding to the $i^{th}$ gate driving group, corresponds to a rising timing of the group driving refresh signal corresponding to the $i-1^{th}$ gate driving group.

4. The display device of claim 1, wherein each of the N logic circuits is included in one of M gate driving integrated circuits, which are included in a corresponding gate driving group of the N gate driving groups.

5. The display device of claim 1, wherein each of the N gate driving groups comprises an odd-numbered gate driving group including odd-numbered gate driving integrated circuits and an even-numbered gate driving group including even-numbered gate driving integrated circuits;

two group driving start signal lines and L group control signal lines are disposed, and 2N logic circuits are disposed, so as to provide a corresponding group driving start signal to an odd-numbered gate driving group and an even-numbered gate driving group included in each of the N gate driving groups; and two or 2N group driving refresh signal lines are disposed, so as to provide a corresponding group driving refresh signal to an odd-numbered gate driving group and an even-numbered gate driving group included in each of the N gate driving groups.

6. The display device of claim 5, wherein the L is the lowest value among natural numbers satisfying $2^L \geq N$.

7. The display device of claim 5, wherein each of the 2N logic circuits executes:

receiving two group driving start reference signals and L group control signals; and outputting a group driving start signal corresponding to an odd-numbered gate driving group or an even-numbered gate driving group, which is included in a corresponding gate driving group of the N gate driving groups.

8. The display device of claim 7, wherein each of the 2N logic circuits includes a single AND gate, and zero to L NOT gates.

9. The display device of claim 8, wherein a single AND gate included in each of the 2N logic circuits executes:

receiving two group driving start reference signals;

directly receiving L group control signals, receiving the L group control signals through L NOT gates, or receiving a few of the L group control signals through NOT gates and directly receiving the remaining group control signals; and outputting a group driving start signal corresponding to an odd-numbered gate driving group or an even-numbered gate driving group included in a corresponding gate driving group.

10. The display device of claim 7, wherein a rising timing of a group driving start signal corresponding to an odd-numbered gate driving group included in an $i^{th}$ gate driving group, corresponds to a falling timing of a group driving refresh signal corresponding to an even-numbered gate driving group included in an $i-1^{th}$ gate driving group; or a falling timing of the group driving start signal corresponding to the odd-numbered gate driving group included in the $i^{th}$ gate driving group, corresponds to a rising timing of the group driving refresh signal corresponding to the even-numbered gate driving group included in the $i-1^{th}$ gate driving group.

11. The display device of claim 5, wherein each of the 2N logic circuits is included in one of M/2 gate driving integrated circuits, which are included in an odd-numbered gate driving group or an even-numbered gate driving group included in a corresponding gate driving group of the N gate driving groups.

* * * * *